US012416128B2

(12) United States Patent
Miller et al.

(10) Patent No.: US 12,416,128 B2
(45) Date of Patent: Sep. 16, 2025

(54) PILE CONNECTION APPARATUS AND METHOD FOR SUPPORTING A VERTICAL PILE

(71) Applicant: Rapid Footings Group, LLC, Youngsville, NC (US)

(72) Inventors: Dale Clayton Miller, Youngsville, NC (US); Julian Young, Grovetown, GA (US); Arch Harold Flanagan, Farmville, NC (US)

(73) Assignee: Rapid Footings Group, LLC, Youngsville, NC (US)

( * ) Notice: Subject to any disclaimer, the term of this patent is extended or adjusted under 35 U.S.C. 154(b) by 246 days.

(21) Appl. No.: 18/171,936

(22) Filed: Feb. 21, 2023

(65) Prior Publication Data

US 2023/0265628 A1 Aug. 24, 2023

Related U.S. Application Data

(60) Provisional application No. 63/312,223, filed on Feb. 21, 2022.

(51) Int. Cl.
*E02D 5/54* (2006.01)
*E02D 27/50* (2006.01)

(52) U.S. Cl.
CPC ..... *E02D 5/54* (2013.01); *E02D 27/50* (2013.01); *E02D 2600/30* (2013.01)

(58) Field of Classification Search
CPC .. E02D 5/54; E02D 5/80; E02D 27/12; E02D 27/14
See application file for complete search history.

(56) References Cited

U.S. PATENT DOCUMENTS

| | | | |
|---|---|---|---|
| 2,001,719 | A | 5/1935 | Greene |
| 3,775,918 | A | 12/1973 | Johnson |
| 4,402,166 | A | 9/1983 | Wortham, Jr. |
| 5,039,256 | A | 8/1991 | Gagliano |
| 5,791,635 | A | 8/1998 | Hull et al. |

(Continued)

FOREIGN PATENT DOCUMENTS

| | | | |
|---|---|---|---|
| JP | 2017186788 | A | 10/2017 |
| NZ | 272269 | * | 6/1995 |

(Continued)

*Primary Examiner* — Sean D Andrish
(74) *Attorney, Agent, or Firm* — Withrow + Terranova, PLLC; Vincent K. Gustafson

(57) ABSTRACT

A pile connection comprises at least one fixture having a collar portion, a plurality of micropile sleeves, a plurality of gusset members extending between the collar portion and the micropile sleeves, and at least one connecting member that couples adjacent gusset members and that is spaced apart from the collar portion. A recess bounded by a wall of the collar portion is configured to contact a portion of a vertical pile. One or more fasteners may be used to press the wall against the vertical pile, with certain embodiments employing two complementary fixtures that may be coupled to one another (e.g., using the fasteners) along opposing sides of the vertical pile. Each micropile sleeve is configured to receive a micropile that may be driven through the sleeve into the ground at a position spaced apart from the vertical pile.

22 Claims, 18 Drawing Sheets

(56) References Cited

U.S. PATENT DOCUMENTS

| | | | | |
|---|---|---|---|---|
| 5,873,679 | A * | 2/1999 | Cusimano | E04B 1/34347 405/251 |
| 6,578,333 | B1 | 6/2003 | Gagliano | |
| 6,910,832 | B2 | 6/2005 | Gagliano et al. | |
| 8,561,361 | B2 | 10/2013 | Bauletti | |
| 8,677,700 | B2 | 3/2014 | Fairbairn et al. | |
| 9,499,998 | B2 | 11/2016 | Bardelli et al. | |
| 9,850,630 | B2 | 12/2017 | Annan et al. | |
| 2013/0227897 | A1 | 9/2013 | Palmer et al. | |
| 2018/0106010 | A1 | 4/2018 | Despotellis | |
| 2020/0283984 | A1 | 9/2020 | Despotellis | |

FOREIGN PATENT DOCUMENTS

| | | | |
|---|---|---|---|
| WO | 2020080964 | A1 | 4/2020 |
| WO | 2022132549 | A1 | 6/2022 |

* cited by examiner

PILE CONNECTION APPARATUS AND METHOD FOR SUPPORTING A VERTICAL PILE

CROSS-REFERENCE TO RELATED APPLICATION(S)

This application claims priority to U.S. Provisional Patent Application No. 63/312,223 filed on Feb. 21, 2022, wherein the entire contents of the foregoing application are hereby incorporated by reference herein.

FIELD OF THE DISCLOSURE

The disclosure relates to a pile connection apparatus and method for supporting a vertical pile, such as may be useful to avoid the need for forming concrete foundations or other foundation types, for the same purpose.

BACKGROUND

Installations of many types (e.g., for streetlights, parking lot lights, fences, display signs, solar panels, and the like) may require a ground-contacting support structure. Such installations may require vertically driven piles that are driven into the ground to a specified depth to provide sufficient support. In many installations, piles are embedded in or attached to concrete foundations, either precast or poured on-site, for additional support. While concrete foundations utilize inexpensive materials, their installation may require significant equipment, labor, and time, thereby increasing their overall expense. In climates that are subject to freezing precipitation, exposed concrete foundations may also be vulnerable to ingress of liquid around surfaces thereof followed by freezing, and repeated freeze-thaw cycles with concomitant ice expansion may cause concrete foundations to rise relative to a ground level, thereby reducing their ability to support piles projecting upward therefrom.

Sometimes, a pile is driven to only a portion of a desired depth but then hits an obstruction, resulting in a refusal or rejection. A refusal refers to an inability for a pile (which may also be referred to as a beam) to reach a desired depth to maintain stability of a support structure. The obstruction or impediment (e.g., compacted substrates, rocks, foreign objects, etc.) impede driving the pile to the desired depth. In such circumstances, a pile usually cannot be moved to a different location when large integrated equipment is being installed. Accordingly, some installers remove a pile, drill through the obstruction, replace the pile, and pour concrete around the installed pile. Such a process is slow and expensive. Other times, a pre-existing pile may need further structural support, such as due to environmental changes. Processes for addressing such issues are typically slow, labor-intensive, and expensive.

Need therefore exists for improved pile connection apparatuses for supporting new or pre-existing vertical piles, to address limitations associated with piles supported by conventional foundations or otherwise driven into ground.

SUMMARY

Aspects disclosed herein include a pile connection apparatus that comprises at least one fixture having a collar portion, a plurality of micropile sleeves, a plurality of gusset members extending between the collar portion and the micropile sleeves, and at least one connecting member coupling adjacent gusset members and being spaced apart from the collar portion. A recess (which in certain embodiments may surround approximately one-half of a perimeter or projected top area of a vertical pile) as defined by the collar portion is bounded by a wall of the collar portion configured to contact a portion of a vertical pile to add support thereto. One or more fasteners may be used to press the wall of the collar portion against the vertical pile, with certain embodiments employing two complementary fixtures that may be coupled to one another (e.g., using the fasteners) along opposing sides of the vertical pile. Each micropile sleeve is configured to receive a micropile that may be driven through the sleeve into the ground at a position radially or laterally spaced apart from the vertical pile.

In one aspect, the disclosure relates to a pile connection apparatus for supporting a vertical pile that comprises a first fixture comprising a first collar portion, a plurality of first micropile sleeves, a plurality of first gusset members coupling the plurality of first micropile sleeves to the first collar portion, and at least one first connecting member coupling adjacent first gusset members of the plurality of first gusset members. The first collar portion comprises a first recess configured to receive a first portion of the vertical pile, with the first recess being bounded by a first wall configured to contact a first pile surface of the first portion of the vertical pile. The plurality of first gusset members project laterally outward from the first collar portion, and the at least one first connecting member is spaced apart from the first collar portion. One or more of (i) the first collar portion and (ii) at least one first gusset member, either comprises, or is configured to receive, at least one fastener configured to cooperate with the one or more of (i) the first collar portion and (ii) at least one first gusset member, and cause the first wall to engage the first pile surface.

In certain embodiments, the plurality of first gusset members are intermediately coupled to the plurality of first micropile sleeves, with the at least one first connecting member arranged between (a) the plurality of first gusset members and (b) the plurality of first sleeve micropile sleeves.

In certain embodiments, each first gusset member of the plurality of first gusset members comprises: (i) a length extending in a direction from the first collar portion to a corresponding first micropile sleeve of the plurality of first micropile sleeves, (ii) a width orthogonal to the length, (iii) a proximal height at a point of contact with the first collar portion, and (iv) a distal height at a point of contact with the at least one first connecting member; wherein, for each first gusset member, the proximal height is greater than the distal height, and the distal height is greater than the width.

In certain embodiments, each first micropile sleeve of the plurality of first micropile sleeves has a first sleeve inlet, a first sleeve outlet, and a first sleeve axis extending through the first sleeve inlet and the first sleeve outlet; and for each first micropile sleeve, the first sleeve axis is non-parallel to the vertical pile to be supported by the pile connection apparatus.

In certain embodiments, each first gusset member of the plurality of first gusset members comprises: a first upper surface, a first lower surface, a first proximal surface proximal to the first collar portion, and a first distal surface distal from the first collar portion. For each first gusset member, a first imaginary plane is definable through the first upper surface, the first lower surface, the first proximal surface, and the first distal surface; and for each first gusset member, the first imaginary plane is non-vertical, and is substantially parallel to the first sleeve axis of the first micropile sleeve coupled to the first gusset member.

In certain embodiments, the first wall is curved in shape, with the pile connection apparatus being configured to support a vertical pile having a cylindrical shape; and the first proximal surface of each first gusset member abuts the first wall, with the first proximal surface being curved in shape to substantially conform to a curvature of the first wall.

In certain embodiments, the pile connection apparatus further comprises a second fixture comprising a second collar portion, a plurality of second micropile sleeves, a plurality of second gusset members coupling the plurality of second micropile sleeves to the second collar portion, and at least one second connecting member coupling adjacent second gusset members of the plurality of second gusset members. The second collar portion comprises a second recess configured to receive a second portion of the vertical pile, the second recess being bounded by a second wall configured to contact a second pile surface of the second portion of the vertical pile, wherein the second portion of the vertical pile opposes the first portion of the vertical pile. The plurality of second gusset members project laterally outward from the second collar portion, and the at least one second connecting member is spaced apart from the second collar portion. One or more of (iii) the second collar portion and (iv) the at least one second gusset member, comprises, or is configured to receive, the at least one fastener, and the at least one fastener is configured to cooperate with the one or more of (iii) the second collar portion and (iv) the at least one second gusset member, and cause the second wall to engage the second pile surface, with the second recess of the second fixture opposing the first recess of the first fixture.

In certain embodiments, each second micropile sleeve of the plurality of second micropile sleeves has a second sleeve inlet, a second sleeve outlet, and a second sleeve axis extending through the second sleeve inlet and the second sleeve outlet; and for each second micropile sleeve, the second sleeve axis is non-parallel to the vertical pile to be supported by the pile connection apparatus.

In certain embodiments, the first recess is configured to receive the first portion of the vertical pile extending around a first perimetral portion spanning a range of 40 to 50 percent of a perimeter or projected top area of the vertical pile, and the second recess is configured to receive the second perimetral portion of the vertical pile extending around a second perimetral portion spanning a range of 40 to 50 percent of the perimeter or a projected top area of the vertical pile.

In certain embodiments, a plurality of first fastener openings are defined in one or more of (i) the first collar portion and (ii) the at least one first gusset member, a plurality of second fastener openings is defined in one or more of (iii) the second collar portion and (iv) the at least one second gusset member, and wherein the first fastener openings are configured to be aligned with the second fastener openings to receive fasteners extending through the aligned first and second fastener openings.

In certain embodiments, one or more fasteners of the at least one fastener is affixed to or integrated with one or more of (i) the first collar portion, (ii) at least one first gusset member, (iii) the second collar portion, and (iv) the at least one second gusset member.

In certain embodiments, the plurality of first gusset members comprises at least three first gusset members.

In certain embodiments, one or more of (i) the first collar portion and (ii) the at least one first gusset member, comprises fastener openings configured to receive at least one U-bolt that is configured to extend around a portion of a perimeter of the vertical pile.

In another aspect, the disclosure relates to a pile connection apparatus for supporting a vertical pile, the apparatus comprising a first fixture, a second fixture, and a plurality of fasteners. The first fixture comprises a first collar portion, a plurality of first micropile sleeves, a plurality of first gusset members coupling the plurality of first micropile sleeves to the first collar portion, and at least one first connecting member coupling adjacent first gusset members of the plurality of first gusset members. The first collar portion comprises a first recess configured to receive a first portion of the vertical pile, the first recess being bounded by a first wall configured to contact a first pile surface of the first portion of the vertical pile. The plurality of first gusset members project laterally outward from the first collar portion, and the at least one first connecting member is spaced apart from the first collar portion. The second fixture comprises a second collar portion, a plurality of second micropile sleeves, a plurality of second gusset members coupling the plurality of second micropile sleeves to the second collar portion, and at least one second connecting member coupling adjacent second gusset members of the plurality of second gusset members. The second collar portion comprises a second recess configured to receive a second portion of the vertical pile, the second recess being bounded by a second wall configured to contact a second pile surface of the second portion of the vertical pile. The plurality of second gusset members project laterally outward from the second collar portion, and the at least one second connecting member is spaced apart from the second collar portion. The plurality of fasteners is configured to cooperate with the first fixture and the second fixture to cause the first wall to engage the first pile surface, to cause the second wall to engage the second pile surface, and to cause the vertical pile to be frictionally engaged between the first fixture and the second fixture.

In certain embodiments, the plurality of first gusset members are intermediately coupled to the plurality of first micropile sleeves, with the at least one first connecting member arranged between (a) the plurality of first gusset members and (b) the plurality of first sleeve micropile sleeves; and the plurality of second gusset members are intermediately coupled to the plurality of second micropile sleeves, with the at least one second connecting member arranged between (c) the plurality of second gusset members and (d) the plurality of second micropile sleeves.

In certain embodiments, each first gusset member of the plurality of first gusset members comprises: (i) a first length extending in a direction from the first collar portion to a corresponding first micropile sleeve of the plurality of first micropile sleeves, (ii) a first width orthogonal to the length, (iii) a first proximal height at a point of contact with the first collar portion, and (iv) a first distal height at a point of contact with the at least one first connecting member, wherein for each first gusset member, the first proximal height is greater than the first distal height, and the first distal height is greater than the first width. Each second gusset member of the plurality of second gusset members comprises: (i) a second length extending in a direction from the second collar portion to a corresponding second micropile sleeve of the plurality of second micropile sleeves, (ii) a second width orthogonal to the length, (iii) a second proximal height at a point of contact with the second collar portion, and (iv) a second distal height at a point of contact with the at least one second connecting member; wherein for each second gusset member, the second proximal height is greater than the second distal height, and the second distal height is greater than the second width.

In certain embodiments, each first micropile sleeve of the plurality of first micropile sleeves has a first sleeve inlet, a first sleeve outlet, and a first sleeve axis extending through the first sleeve inlet and the first sleeve outlet; wherein, for each first micropile sleeve, the first sleeve axis is non-parallel to the vertical pile to be supported by the pile connection apparatus. Each second micropile sleeve of the plurality of second micropile sleeves has a second sleeve inlet, a second sleeve outlet, and a second sleeve axis extending through the second sleeve inlet and the second sleeve outlet; wherein, for each second micropile sleeve, the second sleeve axis is non-parallel to the vertical pile to be supported by the pile connection apparatus.

In certain embodiments, each first gusset member of the plurality of first gusset members comprises: a first upper surface, a first lower surface, a first proximal surface proximal to the first collar portion, and a first distal surface distal from the first collar portion; and each second gusset member of the plurality of second gusset members comprises: a second upper surface, a second lower surface, a second proximal surface proximal to the second collar portion, and a second distal surface distal from the second collar portion. For each first gusset member, a first imaginary plane is definable through the first upper surface, the first lower surface, the first proximal surface, and the first distal surface; and for each first gusset member, the first imaginary plane is non-vertical, and is substantially parallel to the first sleeve axis of the first micropile sleeve coupled to the first gusset member. For each second gusset member, a second imaginary plane is definable through the second upper surface, the second lower surface, the second proximal surface, and the second distal surface; and for each second gusset member, the second imaginary plane is non-vertical, and is substantially parallel to the second sleeve axis of the second micropile sleeve coupled to the second gusset member.

In certain embodiments, the first wall is curved in shape, with the pile connection apparatus being configured to support a vertical pile having a cylindrical shape; the first proximal surface of each first gusset member abuts the first wall, with the first proximal surface being curved in shape to substantially conform to a curvature of the first wall; the second wall is curved in shape, with the pile connection apparatus being configured to support the vertical pile having a cylindrical shape; and the second proximal surface of each second gusset member abuts the second wall, with the second proximal surface being curved in shape to substantially conform to a curvature of the second wall.

In certain embodiments, the vertical pile configured to be supported by the pile connection apparatus comprises a pile cross-sectional width or diameter; the first recess comprises a maximum horizontal depth with a dimension in a range of 40 to 50 percent of the pile width or diameter; and the second recess comprises a maximum horizontal depth with a dimension in a range of 40 to 50 percent of the pile width or diameter.

In certain embodiments, a plurality of first fastener openings are defined in one or more of (i) the first collar portion and (ii) the at least one first gusset member, a plurality of second fastener openings is defined in one or more of (iii) the second collar portion and (iv) the at least one second gusset member, and wherein the first fastener openings are configured to be aligned with the second fastener openings to receive fasteners extending through the aligned first and second fastener openings.

In certain embodiments, one or more fasteners of the plurality of fasteners is affixed to or integrated with one or more of (i) the first collar portion, (ii) at least one first gusset member, (iii) the second collar portion, and (iv) the at least one second gusset member.

In another aspect, the disclosure relates to a method for supporting a vertical pile, the method comprising: positioning a pile vertically to a ground to form a vertical pile; coupling a pile connection apparatus as disclosed herein to the vertical pile, with the first collar portion of the first fixture receiving a first portion of the vertical pile, with the second collar portion of the second fixture receiving a second portion of the vertical pile, and with the plurality of fasteners cooperating with the first and second collar portions to cause the vertical pile to be frictionally engaged therebetween; inserting a plurality of first micropiles through the plurality of first micropile sleeves and into the ground; and inserting a plurality of second micropiles through the plurality of second micropile sleeves and into the ground.

In another aspect, any of the foregoing aspects or embodiments disclosed herein may be combined for additional advantage. Moreover, it is specifically contemplated that features of any one or more embodiments disclosed herein may be combined with or substituted for one another, unless indicated to the contrary.

It is to be understood that both the foregoing general description and the following detailed description are merely exemplary and are intended to provide an overview or framework for understanding the nature and character of the claims. The accompanying drawings are included to provide a further understanding and are incorporated in and constitute a part of this specification. The drawings illustrate one or more embodiment(s) and, together with the description, serve to explain principles and operation of the various embodiments.

DETAILED DESCRIPTION

Figure 1A:
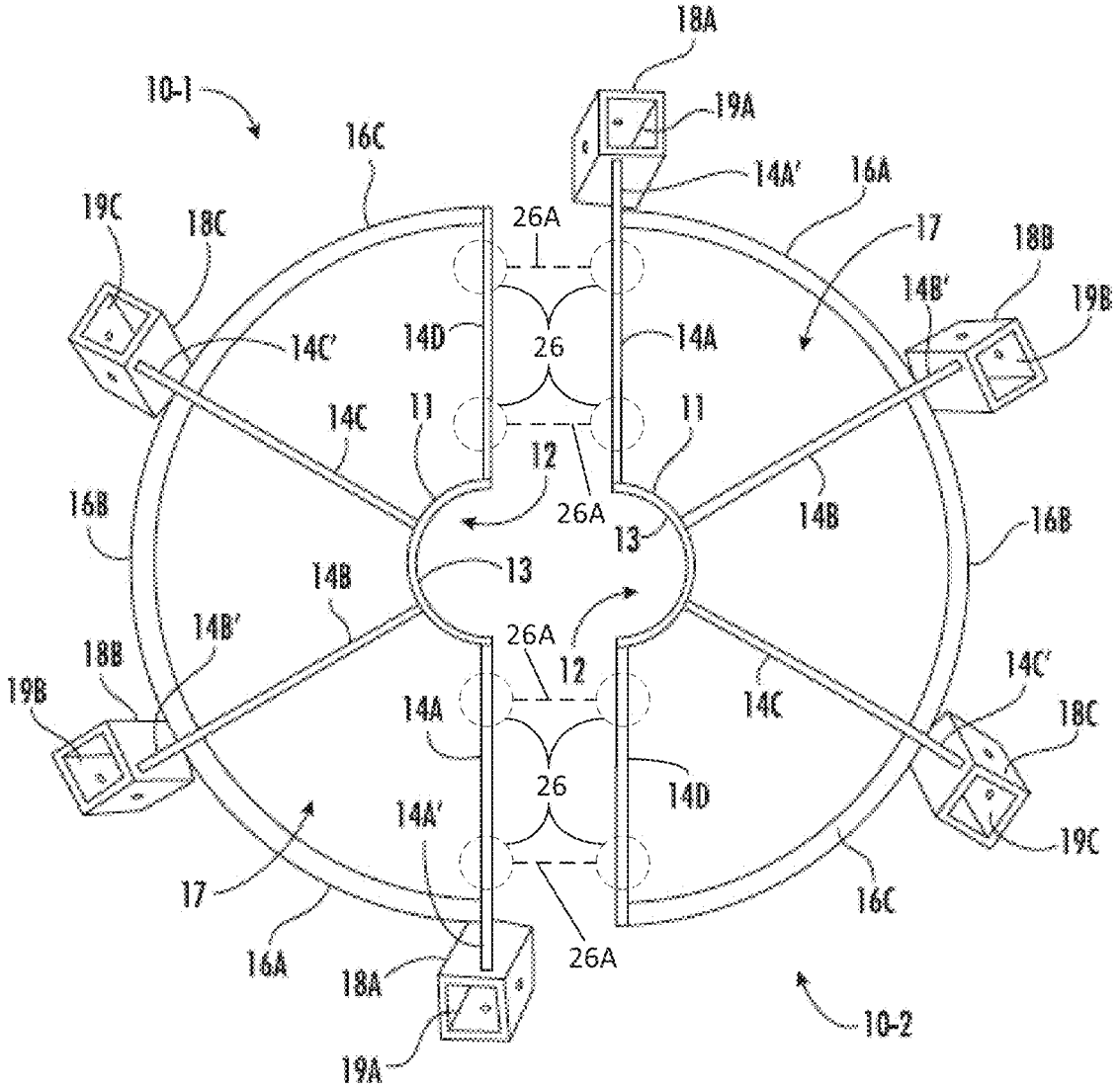
FIG. 1A is a top plan view of complementary first and second fixtures that may be coupled to one another to form a pile connection apparatus according to one embodiment, with each fixture including a recess-defining collar portion, three micropile sleeves, multiple gusset members projecting laterally outward (i.e., toward the micropile sleeves), and connecting members coupling adjacent gusset members, with the connecting members being laterally spaced apart from the collar portion to provide gaps therebetween.

Reference will now be made in detail to the presently preferred embodiments, examples of which are illustrated in the accompanying drawings. Whenever possible, the same reference numerals will be used throughout the drawings to refer to the same or like parts.

Terms such as "left," "right," "top," "bottom," "front," "back," "horizontal," "parallel," "perpendicular," "vertical," "lateral," "coplanar," and similar terms are used for convenience of describing the attached figures and are not intended to limit this description. For example, terms such as "left side" and "right side" are used with specific reference to the drawings as illustrated, and the embodiments may be in other orientations in use. Further, as used herein, terms such as "horizontal," "parallel," "perpendicular," "vertical," "lateral," etc., include slight variations that may be present in working examples.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the present disclosure. As used herein, the term "and/or" includes any and all combinations of one or more of the associated listed items.

It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

The term "vertical" as used herein, may be generally vertical, such as +/−30 degrees, +/−15 degrees, +/−10 degrees, +/−5 degrees, or +/−3 degrees in certain embodiments.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Disclosed is a pile connection apparatus intended to add support to a vertical pile. A pile connection apparatus may utilize one fixture or complementary matching fixtures configured to be coupled with a vertical pile, wherein each fixture includes multiple micropile sleeves each configured to receive a micropile at a location laterally spaced apart from the vertical pile. When one fixture is used, a coupling member and fasteners, or alternatively only fasteners such as U-bolts, may be used to cause a fixture to be coupled with a vertical pile. When multiple fixtures (e.g., two complementary fixtures) are used, such fixtures may be coupled to one another using fasteners (e.g., threaded bolts and nuts, rivets, or other conventional fasteners) around a vertical pile to be supported. Each fixture includes a collar portion that defines a recess configured to receive a portion of a vertical pile. For example, first and second collar portions of complementary fixtures may include walls defining recesses that are semicircular when viewed from above, and when the collar portions are mated together, the recess-defining walls of the respective collar portions may surround substantially an entire perimeter of a portion of a cylindrical pile to be supported. Alternatively, first and second collar portions of complementary fixtures may include walls defining recesses that are rectangular in shape when viewed from above, and when the collar portions are mated together, the recess-defining walls of the respective collar portions may surround substantially an entire perimeter or projected top boundary of a portion of a pile having a rectangular cross-sectional shape. If a single fixture is used in connection with a coupling member, the coupling member may define a recess that may at least partially conform to one half of a perimeter or a projected top boundary of a portion of a vertical pile to be supported, with the fixture defining a complementary recess at least partially conforming to another half of a perimeter of a projected top boundary of the vertical pile.

In certain embodiments, a pile useable with a pile connection apparatus as disclosed herein includes structural metal, such as structural steel, structural aluminum, or other materials. In certain embodiments, the structural metal includes circular tubing, rectangular tubing, square tubing, and flanged bearing piles of various cross-sectional shapes (e.g., I-shaped piles, H-shaped piles, W-shaped piles, C-shaped piles, S-shaped piles, etc., which may also be referred to as beams). In certain embodiments, a pile includes timber (e.g., rectangular cross-section, square cross-section, round cross-section, etc.).

In one embodiment, a pile connection apparatus includes two matching fixtures configured to support (e.g., by compressive engagement) an elongated vertical pile extending along a pile axis. The pile connection apparatus includes a first fixture having a first collar portion defining a recess configured to receive (and preferably match) one side of an elongated pile extending along a pile axis. The first fixture is configured to partially surround the elongated pile. The first fixture includes multiple micropile sleeves coupled with the first collar portion by radially extending first gusset members. Each (first) micropile sleeve comprises a first inlet, a first outlet, and a bore extending therebetween, and is configured to receive a corresponding micropile. A micropile may embody a stake, shaft, or other elongated implement that is generally smaller in length and/or width (e.g., diameter) than a vertical pile to be supported by the pile connection apparatus. The pile connection apparatus further includes a second fixture having a second collar portion configured to receive (and preferably match) an other side of the elongated pile. In certain embodiments, the second fixture may mirror the first fixture. The second fixture further includes multiple micropile sleeves coupled with the second collar portion by radially extending second gusset members. Each (second) micropile sleeve comprises a first inlet, a first outlet, and a bore extending therebetween, and the is configured to receive a corresponding micropile. The first and second fixtures may define holes (e.g., in gusset members, in collar portions (including extending tab portions thereof), or other locations) configured to be aligned with one another to permit the passage of fasteners (e.g., bolts, rivets, etc.) so that the fixtures may be coupled to one another to compressively engage the vertical pile, thus tightly securing the fixtures to the vertical pile.

Fixtures and coupling members as disclosed herein may desirably be formed of metal such as stainless steel, carbon steel, aluminum, or another suitable metal or metal alloy. Since fixtures and coupling members may be positioned outdoors and in contact with a ground surface, such items may have corrosion-resistant features or coatings (e.g., galvanization, paint, and/or other coatings). Material processing methods that may be used for fabricating fixtures and coupling members (and components thereof) may include one or more of rolling, bending, stamping, casting, cutting, machining, welding, and other metal processing steps known in the art.

In certain embodiments, micropile sleeves may be coupled directly to gusset members. In certain embodiments, micropile sleeves may be indirectly coupled to gusset members, with one or more connecting members coupled to the gusset members, and with the micropile sleeves coupled to the one or more connecting members.

One or more connecting members may be used to enhance torsional and structural rigidity of a fixture, which may permit use of longer gusset members (potentially enhancing stability of a pile supported by the pile connection apparatus) and/or permit use of thinner gusset members or less robust mechanical joining (e.g., smaller weld beads) between gusset members and a collar portion. Spacing the connecting members away from a collar portion (e.g., instead of using a continuous plate connecting the collar portion and the gusset members), and providing a gap therebetween, minimizes the potential for accumulation of precipitation, which could facilitate more rapid corrosion and potential for mechanical failure of a fixture.

In certain embodiments, micropile sleeves may include bores configured to guide micropiles in a direction that is not perpendicular to ground, such as an angle in a range of 5 to 35 degrees, or in a range of 10 to 30 degrees, or 15 to 25 degrees, away from true vertical. In certain embodiments, different micropile sleeves may be arranged at different absolute angles, but the same relative angle in comparison to a gusset member proximate to a corresponding micropile sleeve. In certain embodiments, micropile sleeves may include bores configured to guide micropiles in a vertical direction so that micropiles may be driven straight downward into ground.

Reference will now be made to various figures and embodiments disclosed therein.

FIG. 1A is a top plan view of complementary first and second fixtures 10-1, 10-2 that may be coupled to one another to form a pile connection apparatus according to one embodiment. Each fixture 10-1, 10-2 includes a collar portion 11 having a wall 13 defining a semi-cylindrical recess 12 (appearing semi-circular when viewed from above), three micropile sleeves 18A-18C, and multiple gusset members 14A-14D projecting laterally outward (i.e., toward the micropile sleeves 18A-18C). Connecting members 16A-16C that are curved in shape are coupled between adjacent gusset members 14A-14D, with the connecting members 16A-16C being laterally spaced apart from the collar portion 11 to provide gaps 17 between the collar portion and the connecting members 16A-16C, with such gaps 17 being generally wedge-shaped and also extending between adjacent gusset members 14A-14C. The first and second fixtures 10-1, 10-2 are configured to be coupled together with fasteners (e.g., 25 as shown in FIGS. 1B-1E) that are configured to extend through holes defined in gussets 14A, 14D at regions 26, with dashed lines 26A representing paths for insertions of such fasteners. Each micropile sleeve 18A-18C defines a bore 19A-19C for receiving a micropile (not shown). As shown, each micropile sleeve 18A-18C is directly coupled to a corresponding gusset member 14A-14C, and each connecting member 16A-16C is directly coupled to an adjacent pair of gusset members 14A-14C, such that a distal portion 14A'-14C' of each gusset member 14A-14C extends beyond the connecting members 16A-16C to contact a corresponding micropile sleeve 18A-18C.

Figure 1B:
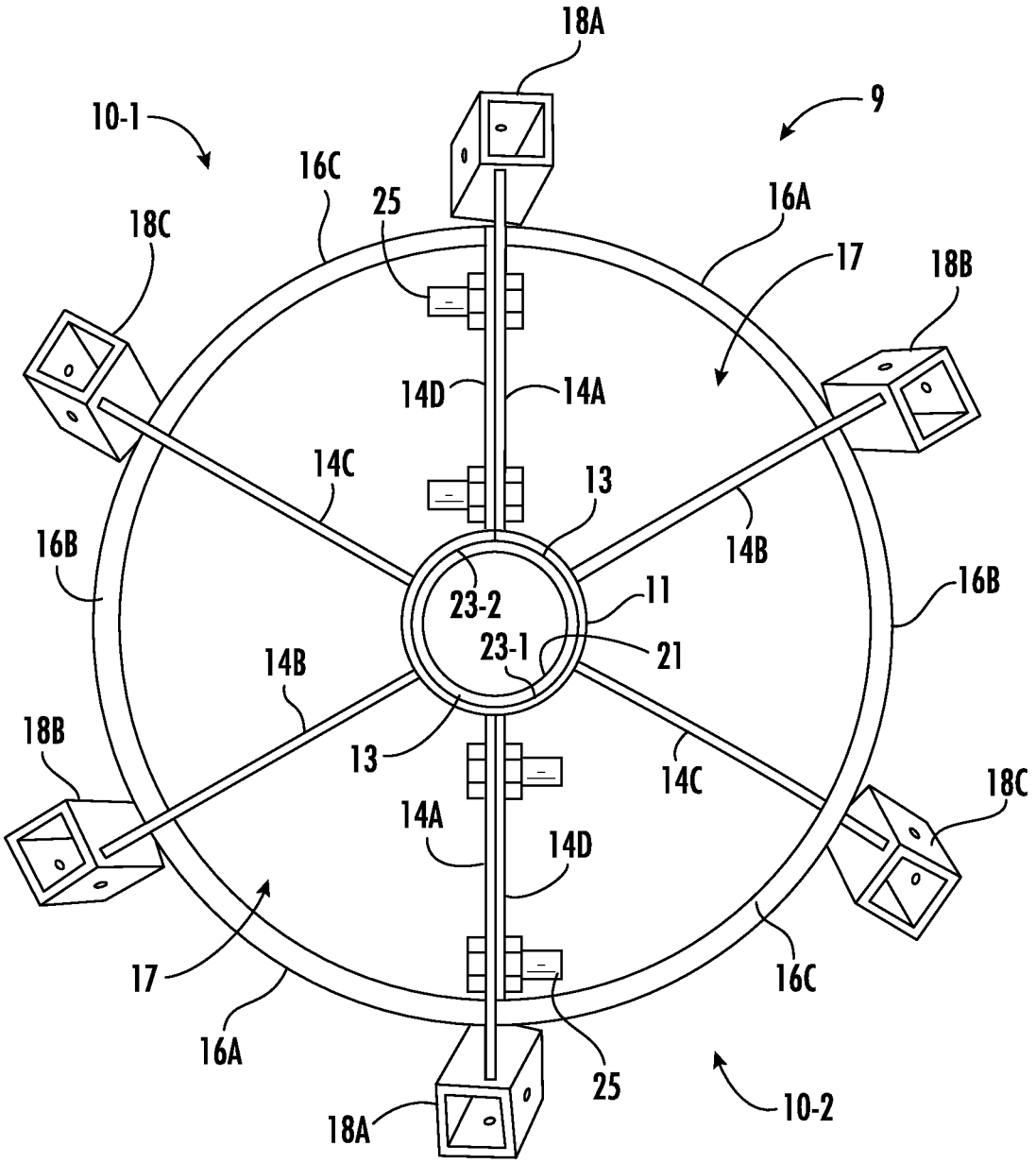
FIG. 1B is a top plan view of the first and second fixtures of FIG. 1A being joined together with fasteners to form a pile connection apparatus according to one embodiment in which a generally cylindrical vertical pile is contacted (and supported) by walls bounding the recesses of the collar portions.

FIGS. 1B-1E provide various views of the first and second fixtures 10-1, 10-2 of FIG. 1A being joined together with fasteners 25 (optionally embodied in threaded bolts and nuts, rivets, or the like) to form a pile connection apparatus 9 according to one embodiment in which a generally cylindrical vertical pile 21 is contacted (and supported) by the walls 13 bounding the recesses 12 (shown in FIG. 1A) of the collar portions 11. As shown in FIG. 1B, the fasteners 25 extend through aligned holes (not shown) defined in the first and fourth gusset members 14A, 14D of the first and second fixtures 10-1, 10-2. Additionally, the vertical pile 21 has two laterally opposing pile surfaces 23-1, 23-2 that are contacted by walls 13 of the collar portions 11 of the second and first fixtures 10-2, 10-1, respectively. In certain embodiments, each collar portion 11 surrounds 50% of a perimeter or projected top border area of the pile 21, such that both collar portions 11 in combination surround an entire perimeter or projected top border area of the pile 21. In certain embodiments, each collar portion surrounds a majority (e.g., in a range of 40 to 50 percent) of a perimeter or projected top border area of the pile 21.

Figure 1C:
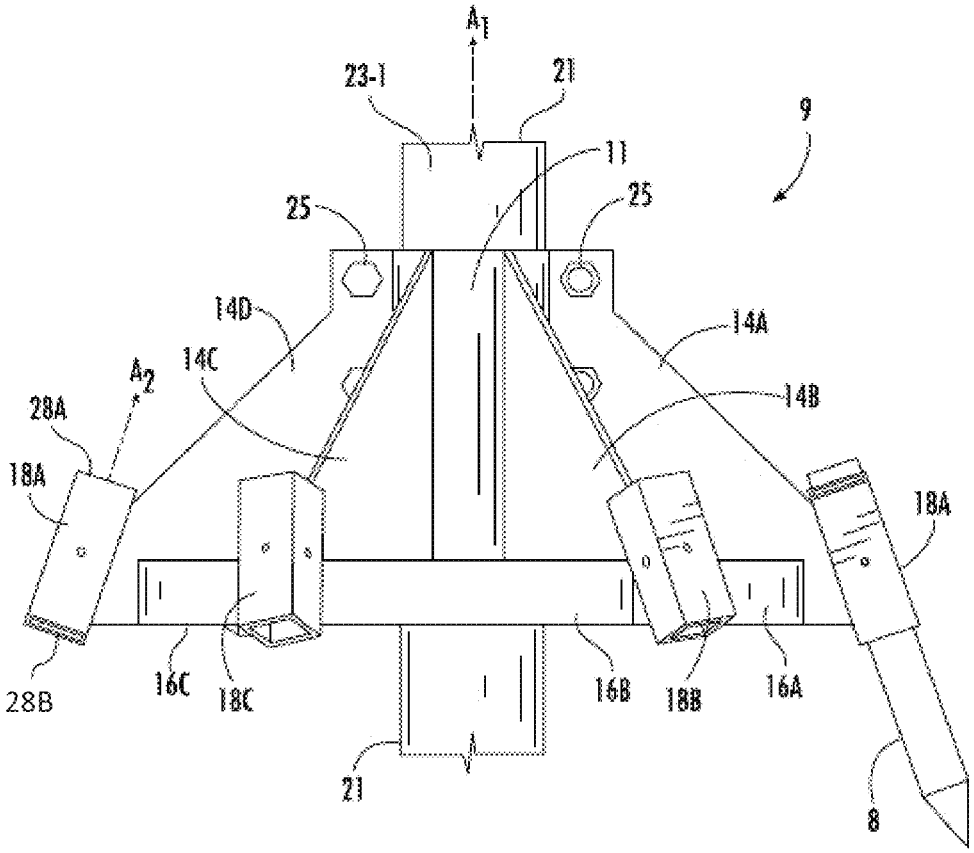
FIG. 1C is a side elevational view of the pile connection apparatus of FIG. 1B.
Figure 1D:
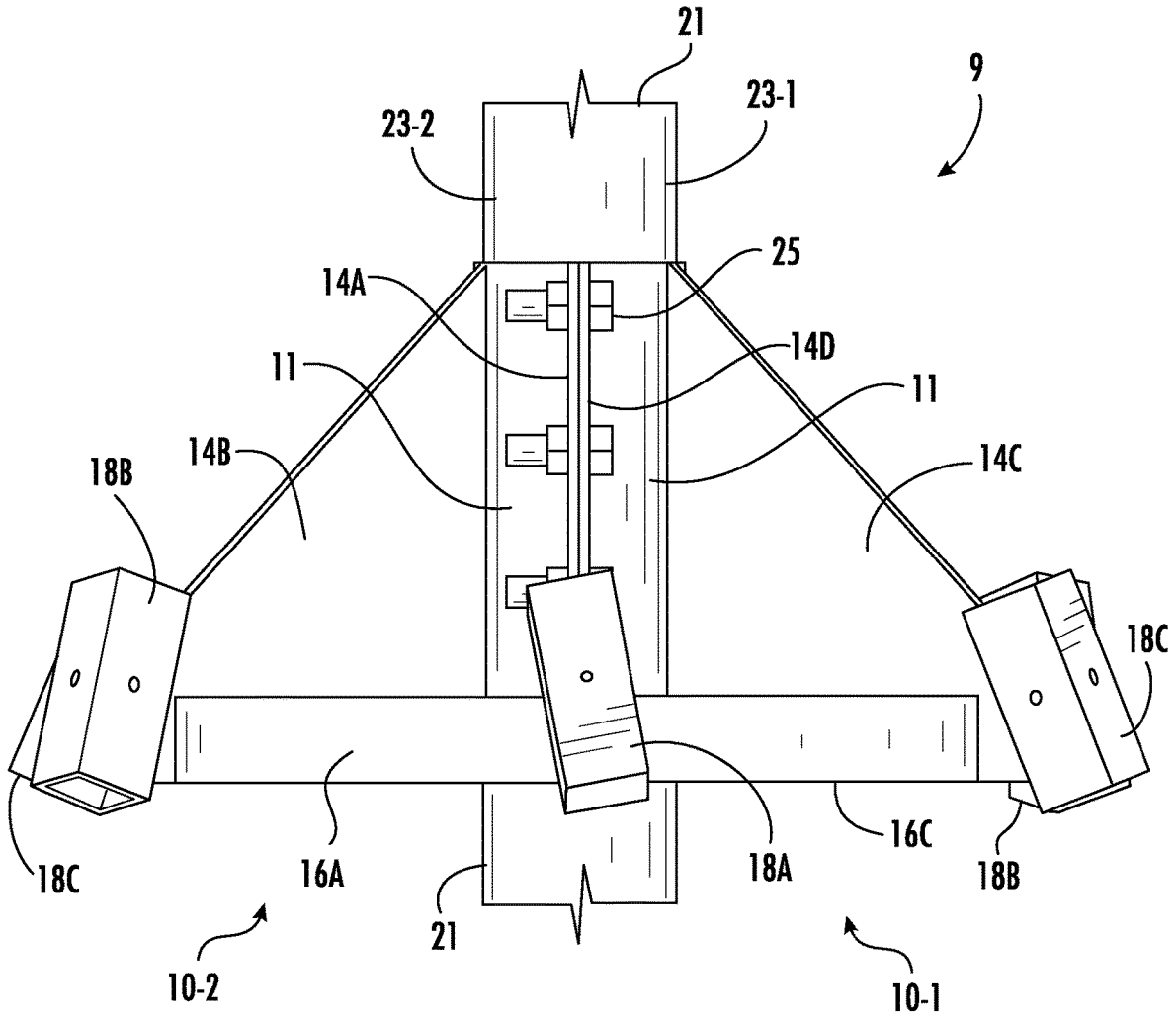
FIG. 1D is a front elevational view of the pile connection apparatus of FIG. 1B.
Figure 1E:
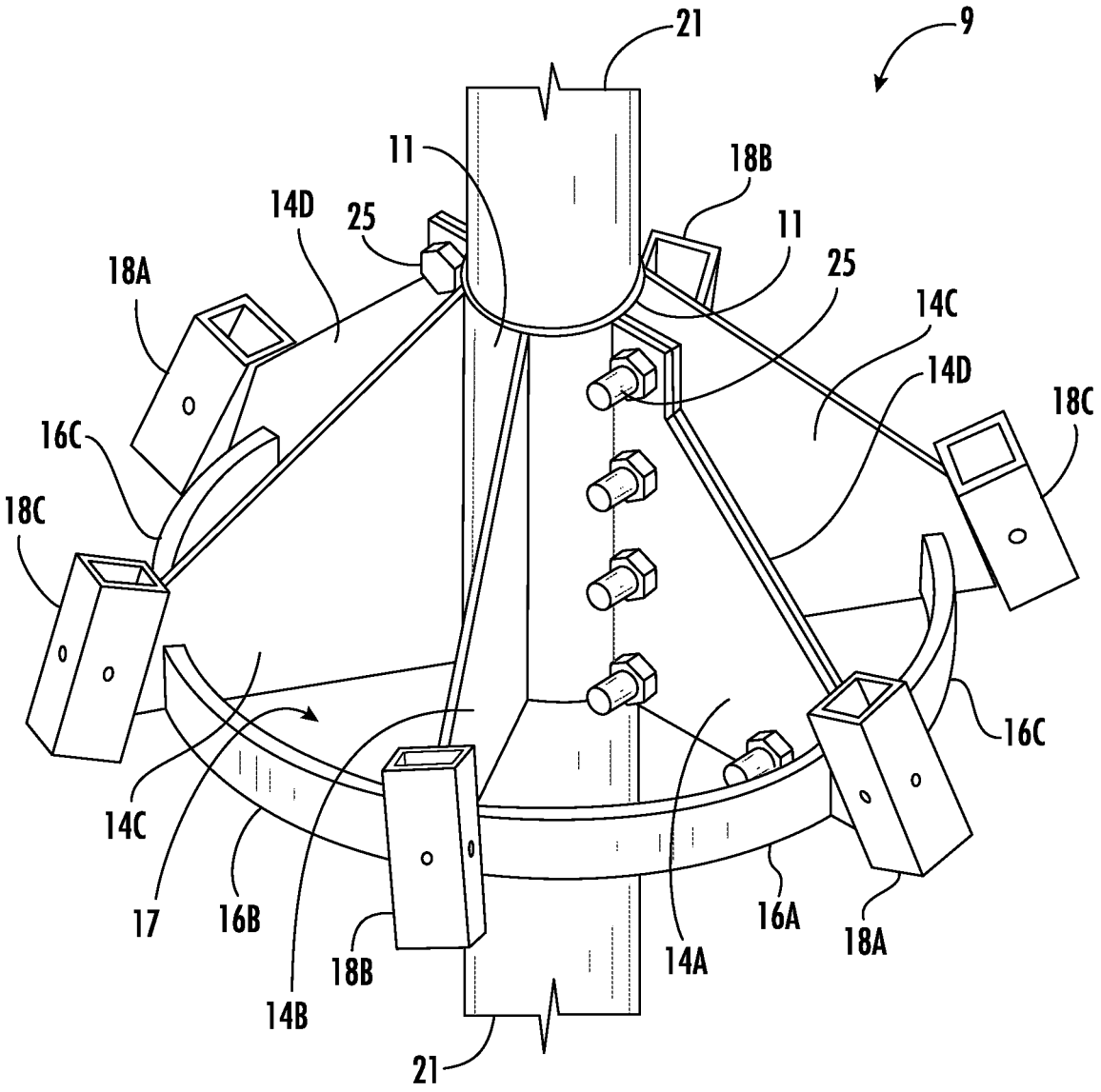
FIG. 1E is a perspective view of the pile connection apparatus of FIG. 1B.

Referring to FIG. 1C, the gusset members 14A-14D may have a generally triangular shape, with an increased height proximate to the collar portions 11 and a reduced height proximate to the micropile sleeves 18A-18C. Each micropile sleeve (but illustrated only in connection with 18A) has a sleeve axis $A_2$, and has a corresponding inlet 28A and outlet 28B communicating with the bore thereof (e.g., bore 19A shown in FIG. 1A) to permit passage of a micropile. Although each micropile sleeve 18A-18C may have a sleeve axis $A_2$ pointing in a different absolute direction, each sleeve axis $A_2$ is non-parallel to a pile axis $A_1$ of the pile 21, and each sleeve axis $A_2$ may have the same or different orientation relative to a corresponding gusset member 14A-14C with which the sleeve member 18A-18C is coupled. FIG. 1C also shows a micropile 8 extending through one micropile sleeve 18A, although it is to be appreciated that in use, each micropile sleeve 18A-18C would have a micropile extending therethrough and into the ground (not shown) below the connecting members 16A-16C. FIG. 1D shows opposing pile surfaces 23-1, 23-2 at a level above the collar portions 11 of the respective fixtures 10-1, 10-2. FIG. 1E shows a lower portion of the vertical pile 21 extending below the collar portions 11 as being visible through the gaps 17 between the connecting members 16A-16C and the gusset members 14A-14C, but it is to be appreciated that in use, the connecting members 16A-16C may be arranged at a ground surface, with a lower portion of the pile 21 being driven downward into the ground and therefore obscured from view. The remaining elements of FIGS. 1B to 1E are the same as previously described in connection with FIG. 1A. In use, a pile may be positioned vertically relative to a ground (and optionally, driven partially into the ground) to form a vertical pile 21; the fixtures 10-1, 10-2 may be coupled (using fasteners 25) to the vertical pile; and multiple micropiles may be inserted through the micropile sleeves 18A-18C into the ground. In certain embodiments, the fixtures 10-2, 10-2 may be coupled to the vertical pile 21 after the vertical pile 21 is driven into the ground. In certain embodiments, the fixtures 10-1, 10-2 may be coupled to the vertical pile 21 before the vertical pile 21 is driven into the ground.

Figure 2A:
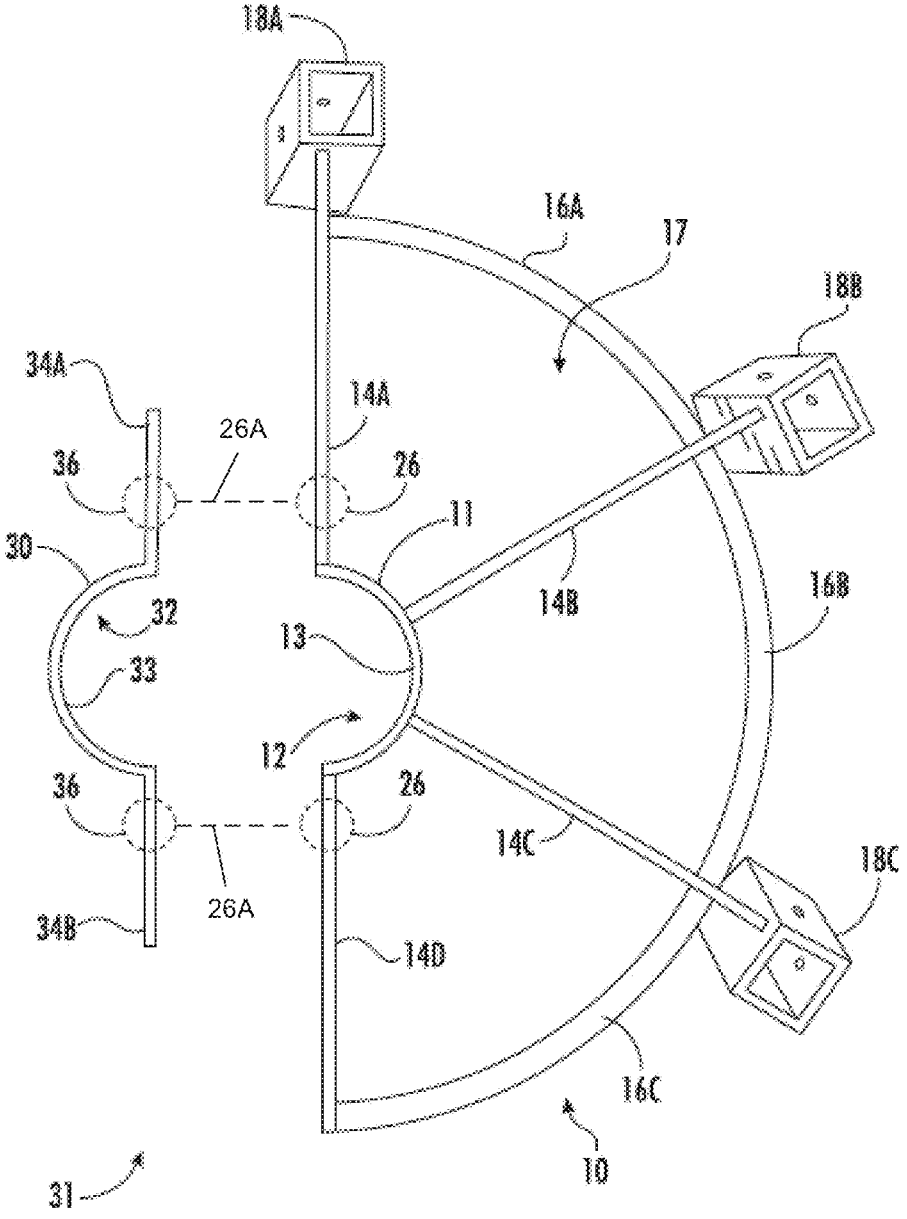
FIG. 2A is a top plan view of a fixture according to FIG. 1A positioned adjacent to a coupling member that defines a collar portion, with the fixture and coupling member being configured to be coupled together with fasteners to form a pile connection apparatus.
Figure 2B:
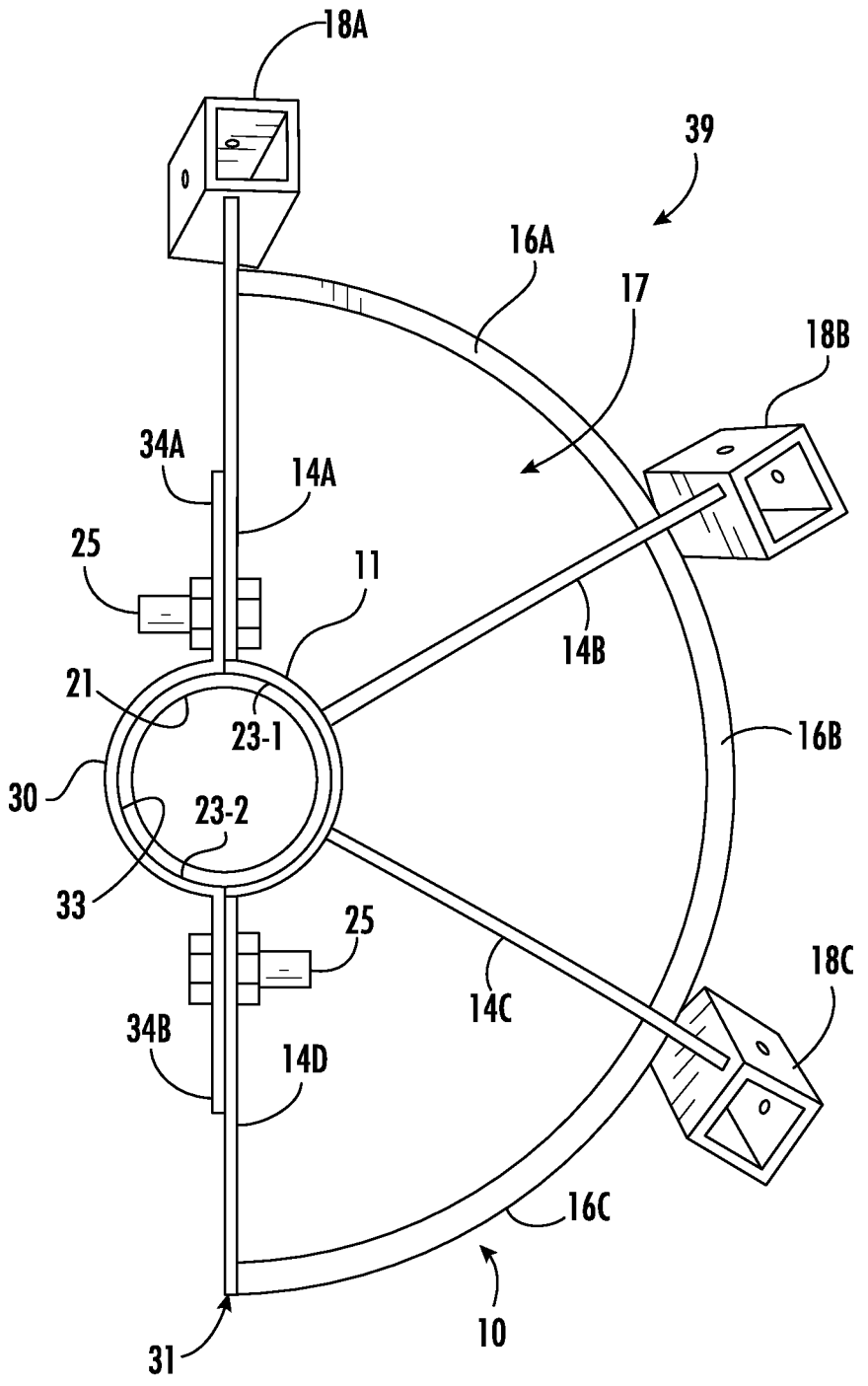
FIG. 2B is a top plan view of the fixture and coupling member of FIG. 2A being coupled together with fasteners to form a pile connection apparatus in which a generally cylindrical vertical pile is contacted (and supported) by walls bounding the recesses of the collar portions.

FIGS. 2A-2B illustrate an embodiment in which a single fixture 10 (identical to the fixtures 10-1, 10-2 of FIG. 1A) may be used in conjunction with a coupling member 31 and fasteners (25 in FIG. 2B) to support a vertical pile. FIG. 2A shows the fixture 10 positioned adjacent to the coupling member 31 incorporating a collar portion 30 having a wall 33 that defines a recess 32 and having two outwardly projecting tab extensions 34A, 34B. The tab extensions 34A, 34B define holes at regions 36, with such holes being aligned with corresponding holes defined in the first and fourth gusset members 14A, 14D at regions 26 of the fixture 10 with dashed lines 26A representing paths for insertion of fasteners (e.g., 25 as shown in FIG. 2B). The remaining elements of the fixture 10 are the same as those of fixtures 10-1, 10-2 described in connection with FIG. 1A. FIG. 2B shows the fixture 10 and coupling member 31 of FIG. 2A being coupled together with fasteners 25 (extending through the above-described holes in the tab extensions 34A, 34B and in the first and fourth gusset members 14A, 14D) to form a pile connection apparatus 39 in which a generally cylindrical vertical pile 21 is contacted (and supported) by walls 13, 33 bounding the recesses 32, 12 of the collar portions 11. In particular, the vertical pile 21 has one pile surface 23-1 contacting the wall 13 of the collar portion 11 of the fixture 10, and the vertical pile has another, opposing pile surface 23-1 contacting the wall 33 of the collar portion 30 of the coupling member 31. The pile connection apparatus 39 may be useful in situations where limited support for a pile 21 is needed and/or where lateral clearance is limited (e.g., if the pile 21 is located adjacent to a pre-existing structure such as a wall that would not accommodate presence of a second fixture coupled to the fixture 10).

As an alternative to using a coupling member or a second fixture, in certain embodiments a fixture may be used with one or more U-bolts to provide support to a vertical pile.

Figure 3:
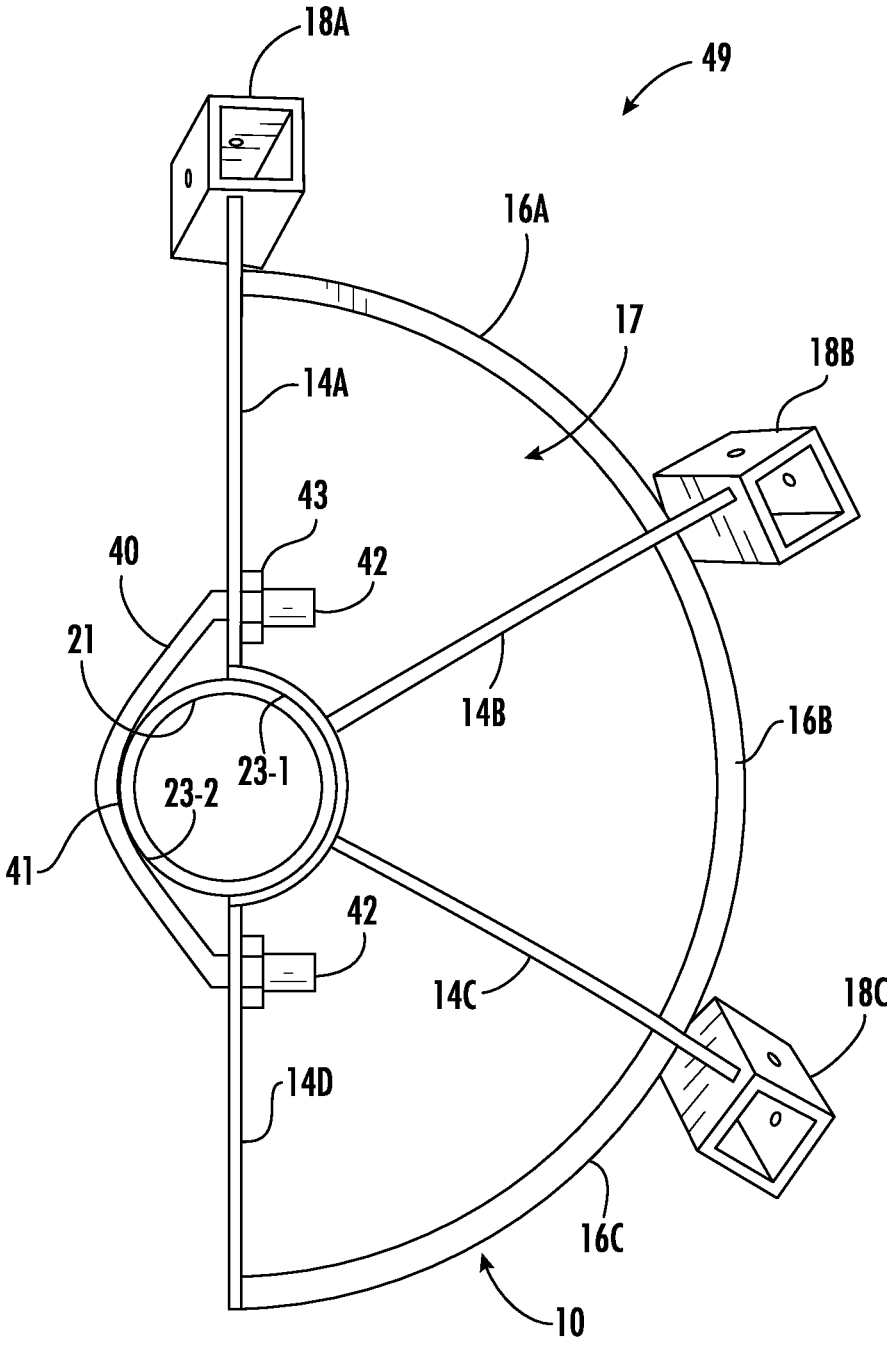
FIG. 3 is a top plan view of a fixture according to FIG. 1A cooperating with a U-bolt to form a pile connection apparatus in which a generally cylindrical vertical pile is contacted (and supported) between the U-bolt and a wall bounding a recesses of the collar portion of the fixture.

FIG. 3 is a top plan view of a fixture 10 according to FIG. 1A cooperating with a U-bolt 40 to form a pile connection apparatus 49 in which a generally cylindrical vertical pile 21 is contacted (and supported) between a medial surface 41 of the U-bolt 40 and a wall 13 bounding a recess of the collar portion 11 of the fixture 10. The U-bolt has threaded ends 42 that cooperate with nuts 43 and extend through holes defined in the first and fourth gusset members 14A, 14D. The vertical pile 21 has one pile surface 23-1 contacting the wall 13 of the collar portion 11 of the fixture 10, and the vertical pile has another, opposing pile surface 23-2 contacting the medial surface 41 of the U-bolt 40. It is to be appreciated that multiple U-bolts 40 may be provided and offset from one another vertically to cooperate with multiple pairs of holes defined in the first and fourth gusset members 14A, 14D.

Figure 4A:
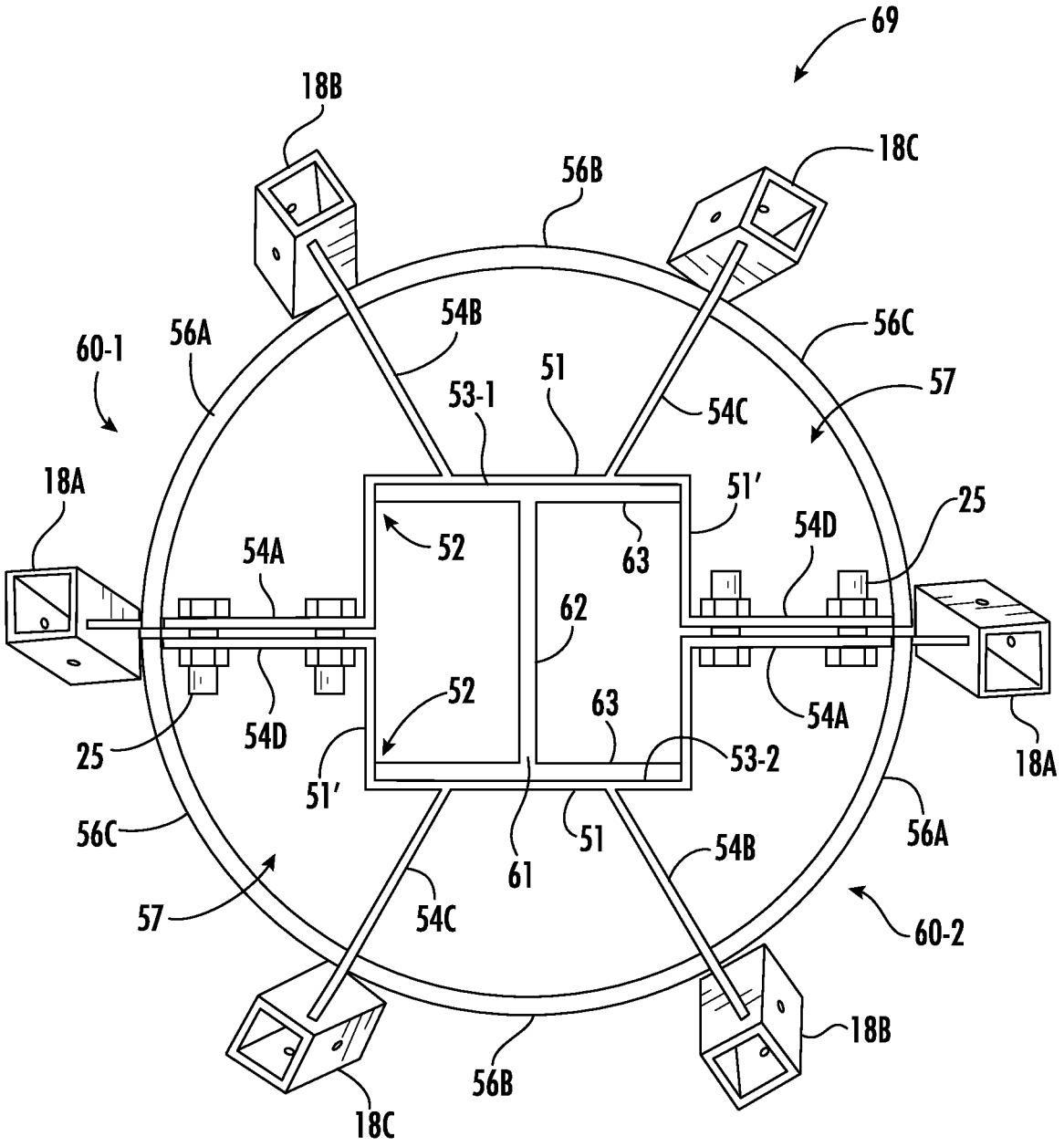
FIG. 4A is a top plan view of first and second fixtures (each similar to the figures shown in FIG. 1A but defining rectangular recesses in collar portions thereof) being joined together with fasteners to form a pile connection apparatus according to one embodiment in which a vertical pile having a rectangular cross-sectional shape is contacted (and supported) by walls bounding the recesses of the collar portions.
Figure 4B:
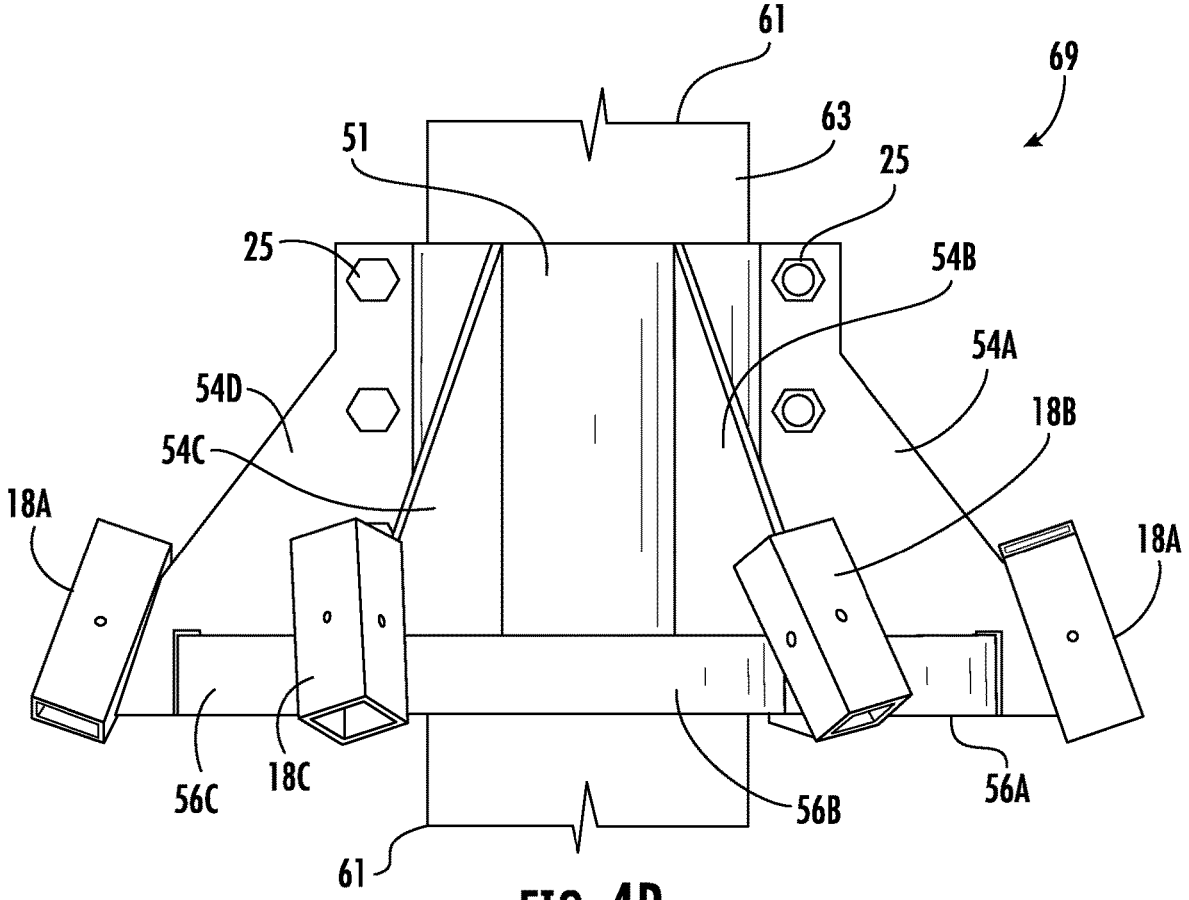
FIG. 4B is a front elevational view of the pile connection apparatus of FIG. 4A.
Figure 4C:
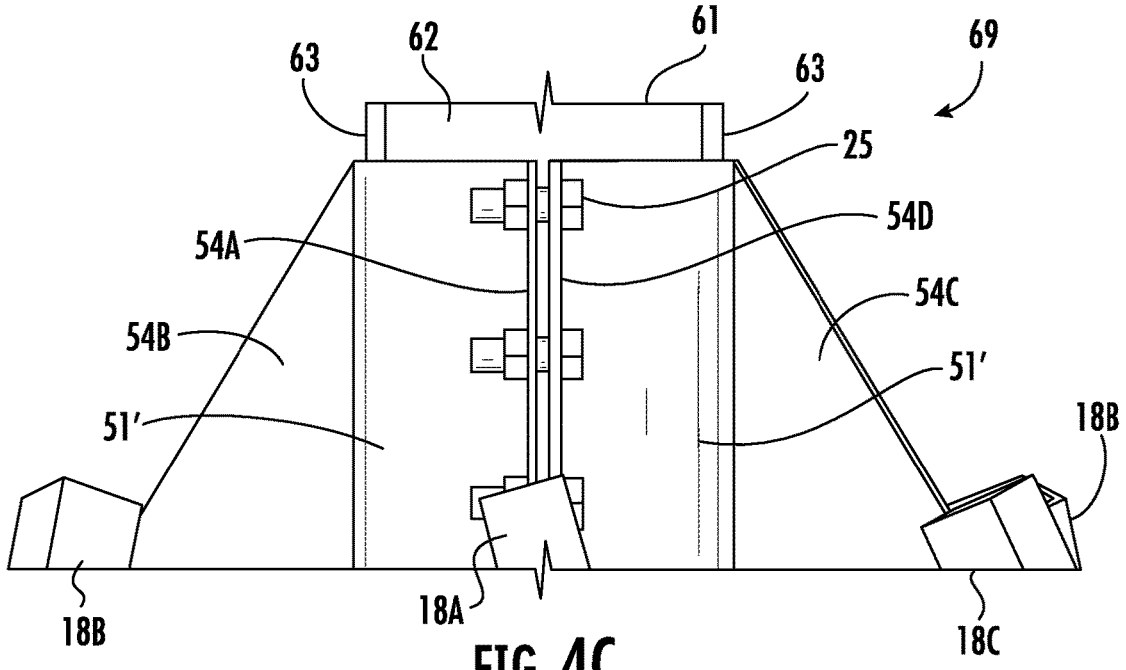
FIG. 4C is a front elevational view of the pile connection apparatus of FIG. 4A.
Figure 4D:
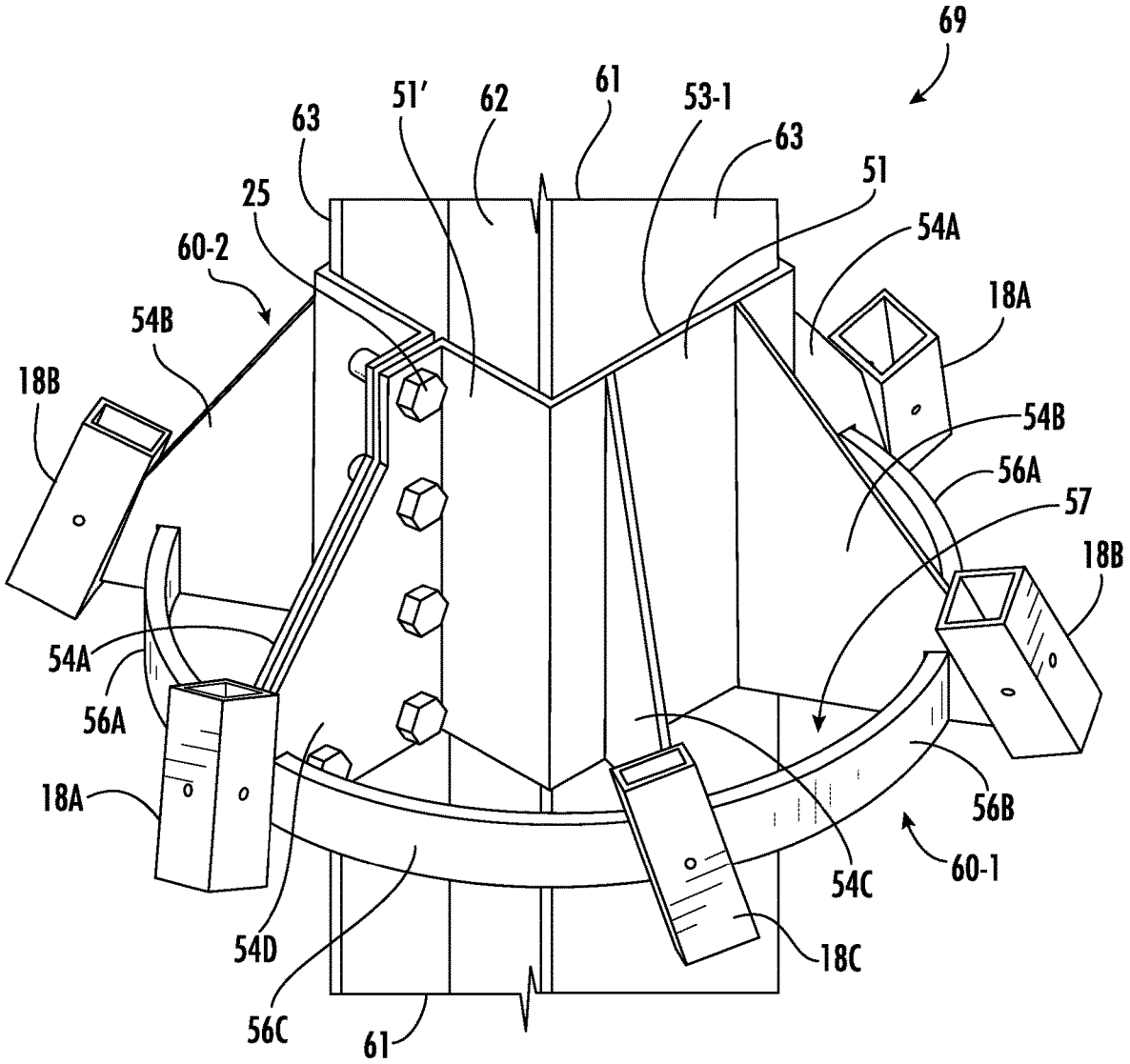
FIG. 4D is a perspective view of the pile connection apparatus of FIG. 4A.

FIG. 4A is a top plan view of first and second fixtures 60-1, 60-2 that define rectangular recesses 52 in collar portions 51 thereof, and that are joined together with fasteners 25 to form a pile connection apparatus 69 according to one embodiment in which a vertical pile 61 having a rectangular cross-sectional shape (e.g., with a central web 62 and two peripheral flanges 63 arranged perpendicular to the web 62) is supported. Each fixture 60-1, 60-2 includes a collar portion 51 with perpendicular wall extensions 51' that bound a rectangular recess 52 (appearing rectangular when viewed from above), three micropile sleeves 18A-18C, and multiple gusset members 54A-54D projecting laterally outward (i.e., toward the micropile sleeves 18A-18C). Connecting members 56A-56C that are curved in shape are coupled between adjacent gusset members 54A-54D, with the connecting members 56A-56C being laterally spaced apart from the collar portion 51 to provide gaps 57 between the collar portion 51 and the connecting members 56A-56C, with such gaps 57 each having a modified wedge shape and also extending between adjacent gusset members 54A-54C. Each micropile sleeve 18A-18C is directly coupled to a corresponding gusset member 54A-54C, and each connecting member 56A-56C is directly coupled to an adjacent pair of gusset members 54A-54C. As shown in FIG. 4A, the fasteners 25 extend through aligned holes (not shown) defined in the first and fourth gusset members 54A, 54D of the first and second fixtures 60-1, 60-2. Additionally, the vertical pile 61 has two laterally opposing pile surfaces 53-1, 53-2 that are contacted by walls of the collar portions 51 of the fixtures 60-1, 60-2, respectively. In certain embodiments, each collar portion 51 surrounds 50% of a perimeter or projected top border area of the pile 61, such that both collar portions 51 in combination surround an entire perimeter or projected top border area of the pile 61. In certain embodiments, each collar portion surrounds a majority (e.g., in a range of 40 to 50 percent) of a perimeter or projected top border area of the vertical pile 61. FIGS. 4B-4D provide additional (i.e., front elevational, side elevational, and perspective) views of the pile connection apparatus 69 affixed to the pile 61. The micropile sleeves 18A-18C are each oriented with central axes non-parallel to a central axis of the vertical pile 61. As shown, the gusset members 54A-54D each have a generally triangular shape, with an increased height proximate to the collar portions 51 and a reduced height proximate to the micropile sleeves 18A-18C. FIG. 4D shows a lower portion of the vertical pile 61 extending below the collar portions 51 as being visible through the gaps 57 between the connecting members 56A-56C and the gusset members 54A-54C, but it is to be appreciated that in use, the connecting members 56A-56C may be arranged at a ground surface, with a lower portion of the vertical pile 61 being driven downward into the ground and therefore obscured from view.

Although various preceding figures have shown vertical piles having generally circular and generally rectangular cross-sectional shapes or borders, it is to be appreciated that collar portions of fixtures and coupling members disclosed herein may be shaped to receive vertical piles of any suitable external cross-sectional shape.

In certain embodiments, micropile sleeves may be indirectly coupled to gusset members, such as by positioning one or more (inter-gusset) connecting members therebetween. Additionally, in certain embodiments, fasteners may extend through holes defined in outwardly projecting tab extensions of a collar portion and defined in inwardly projecting tab extensions of a connecting member.

Figure 5A:
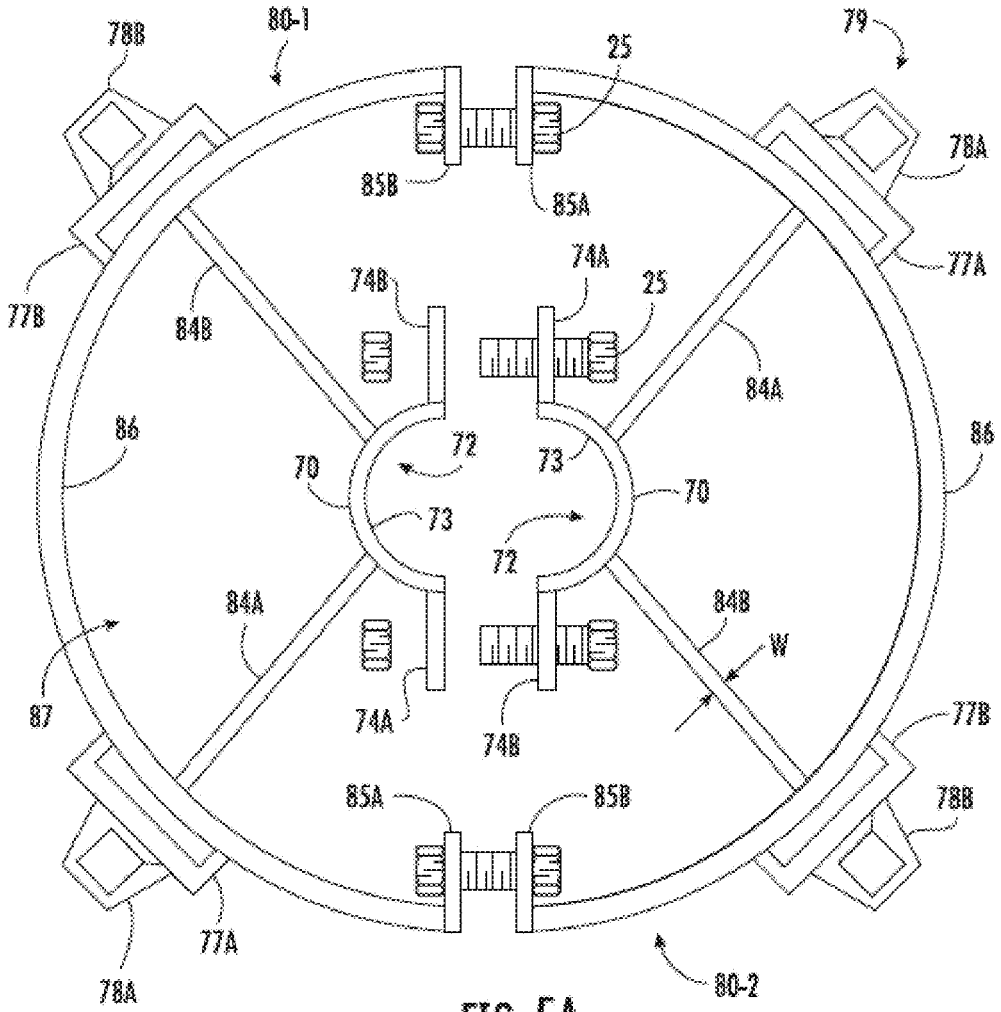
FIG. 5A is a top plan view of first and second fixtures configured to be coupled together with fasteners to form a pile connection apparatus according to one embodiment, with each fixture including two gusset members, a single connecting member connecting the gusset members, a collar portion, two micropile sleeves indirectly coupled to the gusset members through the connecting member, and fastener receiving holes defined in outwardly projecting tab extensions of a collar portion and defined in inwardly projecting tab extensions of the connecting member.
Figure 5B:
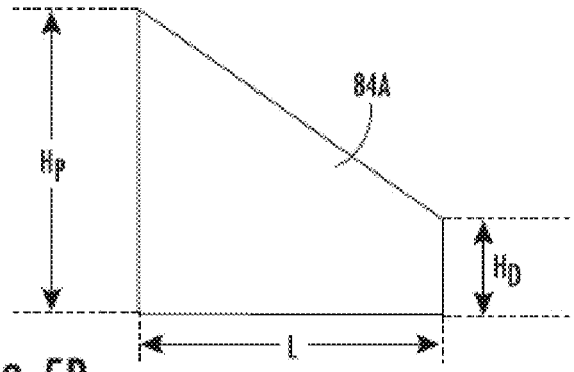
FIG. 5B is a side elevational view of a gusset member of a fixture of FIG. 5A.

FIG. 5A is a top plan view of first and second fixtures 80-1, 80-2 configured to be coupled together with fasteners 25 to form a pile connection apparatus 79 according to one embodiment. Each fixture 80-1, 80-2 includes two gusset members 84A, 84B, a single connecting member 86 connecting (and extending past) the gusset members 84A, 84B, a collar portion 70, and two micropile sleeves 78A, 78B (and optional mounting plates 77A, 77B for the micropile sleeves 78A, 78B) indirectly coupled to the gusset members 84A, 84B through the connecting member 86. Each fixture 80-1, 80-2 further includes fastener receiving holes defined in outwardly projecting tab extensions 74A, 74B of the collar portion 70 and defined in inwardly projecting tab extensions 85A, 85B of the connecting member 86. Such a configuration does not require any holes to be defined in the gusset members 84A, 84B. Each collar portion 70 further includes a wall 73 bounding a recess 72 that is configured to receive and contact an outer surface portion of a vertical pile (not shown). For each fixture 80-1, 80-2, a gaps 87 is provided between the connecting member 86, the collar portion 70, and the gusset members 84A-84B. FIG. 5B shows a gusset member 84A of each fixture 80-1, 80-2, showing that the gusset member 84A has a length L, and has a proximal height (Hp) (at an edge adjacent to the collar portion) that is greater than the distal height HD (at an edge distal from the collar portion, and proximate to the connecting member 86). Additionally, for each gusset member 84A, 84B, the distal height Hp is greater than the width W thereof.

Figure 6A:
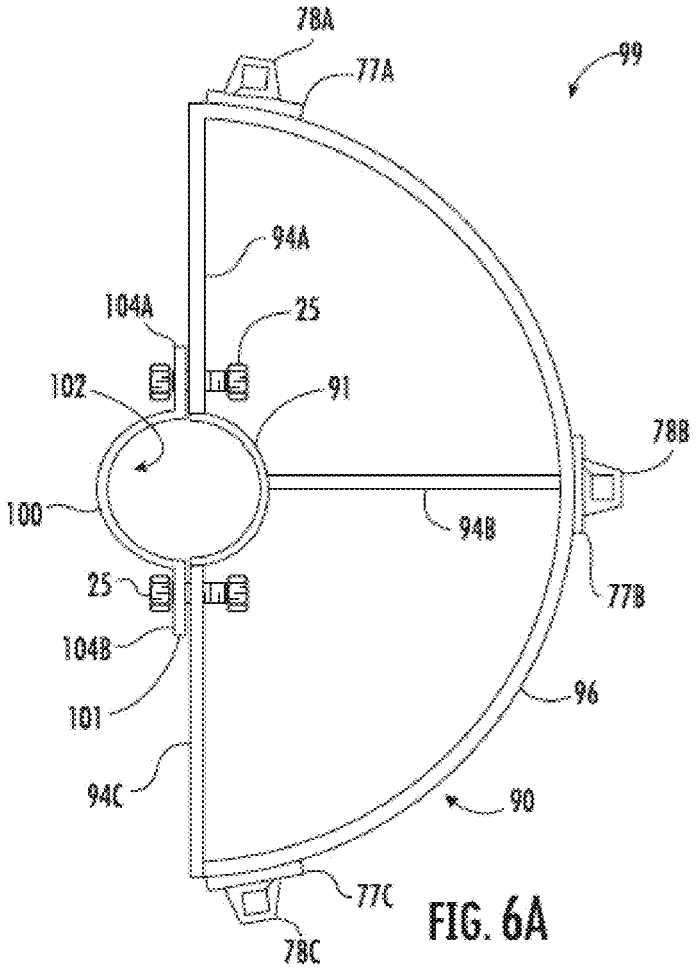
FIG. 6A is a top plan view of a fixture joined by fasteners to a coupling member to form a pile connection apparatus according to one embodiment, the fixture including three gusset members, a single connecting member connecting the gusset members, three micropile sleeves indirectly coupled to the gusset members through the connecting member, and a collar portion, with fastener receiving holes defined in two gusset members and in projecting tab extensions of the coupling member.
Figure 6B:
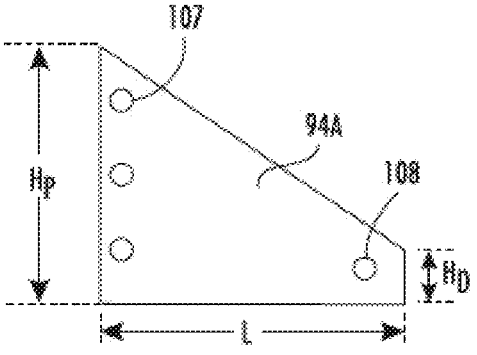
FIG. 6B is a side elevational view of a gusset member of the fixture of FIG. 6A.
Figure 6C:
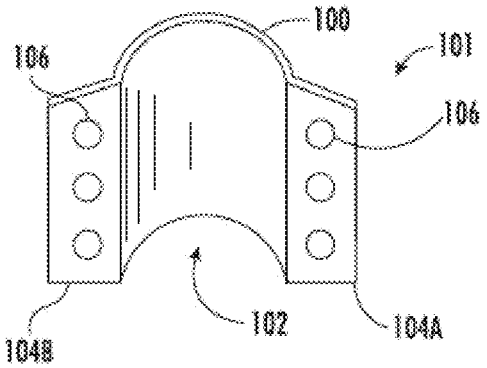
FIG. 6C is a perspective view of the coupling member of FIG. 6A.

FIG. 6A is a top plan view of a fixture 90 joined by fasteners 25 to a coupling member 101 to form a pile connection apparatus 99 according to one embodiment. The fixture 90 includes a collar portion 91, three gusset members 94A-94C, a single connecting member 96 connecting the gusset members 94A-94C, three micropile sleeves 78A-78C (and optional mounting plates 77A-77C for the micropile sleeves 78A-78C) indirectly coupled to the gusset members 94A-94C through the connecting member 96. Fastener receiving holes are defined in two gusset members 94A, 94C and in projecting tab extensions 104A, 104B of the coupling member 101. The coupling member 101 includes a wall 100 defining a recess 102 and the projecting tab extensions 104A. 104B thereof, with fastener receiving holes 106 (shown in FIG. 6C) defined in the tab extensions of the coupling member 101. FIG. 6B shows a gusset member 94A of the fixture 90, showing fastener receiving holes 107, 108, as well as depicting a length L, a proximal height (Hp) (at an edge adjacent to the collar portion 91) that is greater than the distal height HD (at an edge distal from the collar portion 91, and proximate to the connecting member 96). Additionally, for each gusset member 94A-94C, the distal height Hp is greater than a width thereof. FIG. 6C provides a perspective view of the coupling member 101 as described above.

Figure 7A:
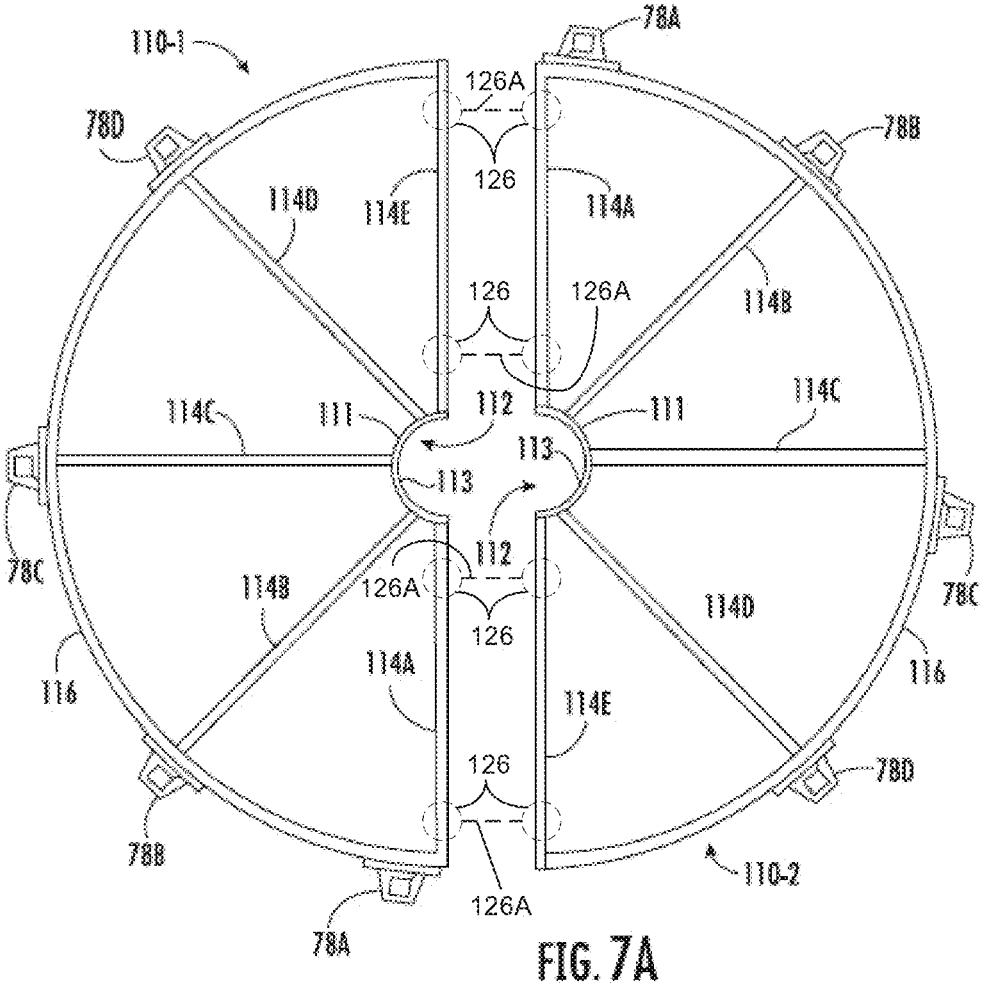
FIG. 7A is a top plan view of first and second fixtures configured to be coupled together with fasteners to form a pile connection apparatus according to one embodiment, with each fixture including five gusset members, a single connecting member connecting the gusset members, a collar portion, four micropile sleeves indirectly coupled to the gusset members through the connecting member, and fastener receiving holes defined in selected gusset members.
Figure 7B:
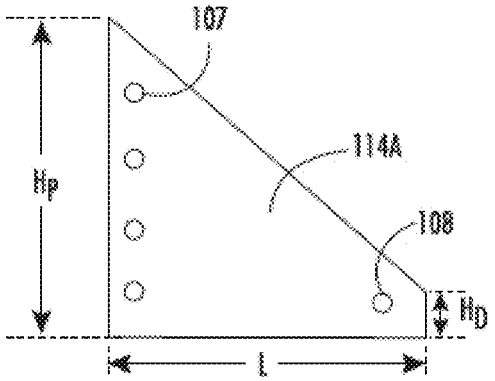
FIG. 7B is a side elevational view of a gusset member of a fixture of FIG. 7A.
Figure 8A:
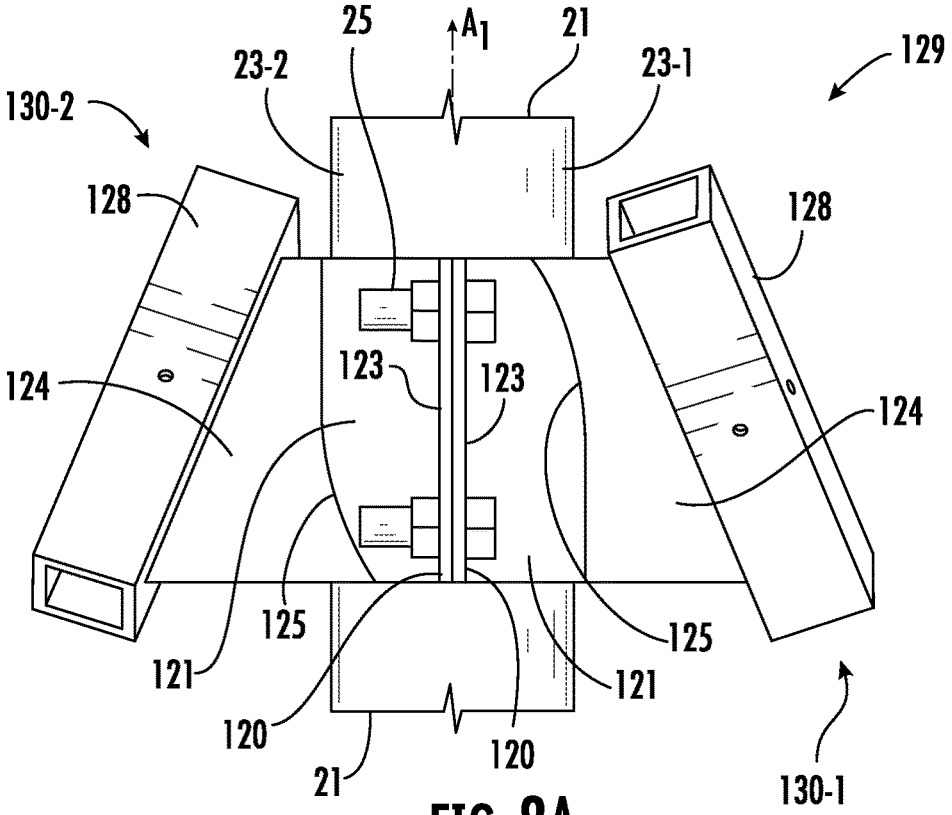
FIG. 8A is side elevational view of a pile connection apparatus affixed to a cylindrical vertical pile, the pile connection apparatus including two complementary fixtures joined with fasteners, with each fixture having a collar portion and one gusset member extending from the collar portion to a micropile sleeve without any connecting members spanning between micropile sleeves, with each gusset member being inclined away from vertical and having a curved proximal surface to conform to a curved surface of a wall of the collar portion.
Figure 8B:
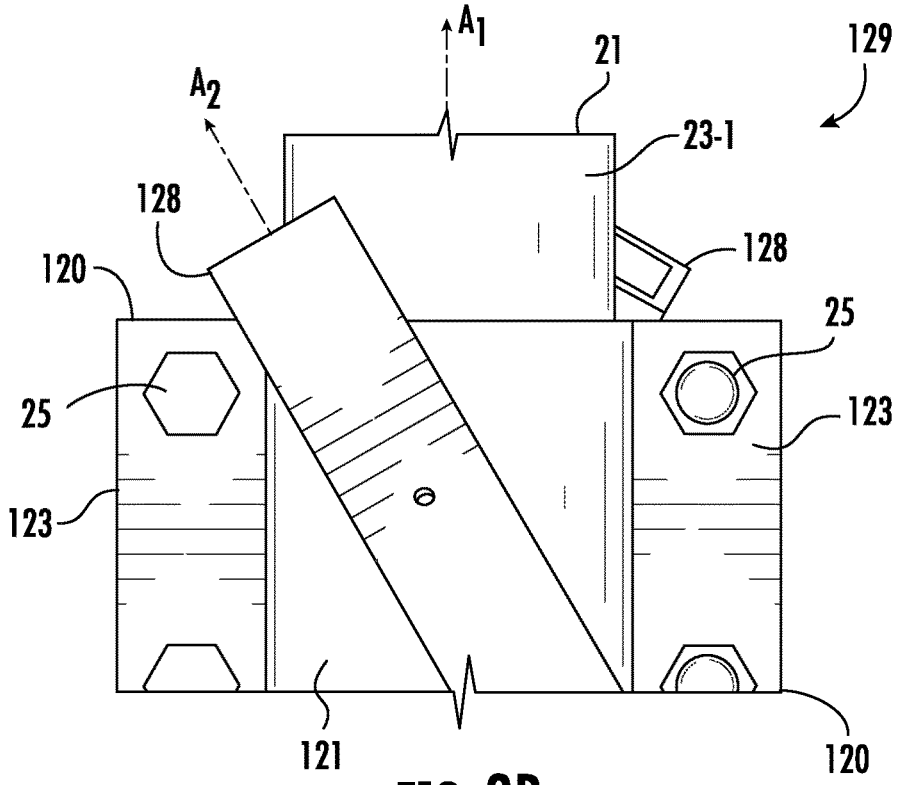
FIG. 8B is a front elevational view of a portion of the pile connection apparatus and vertical pile of FIG. 8A.
Figure 8C:
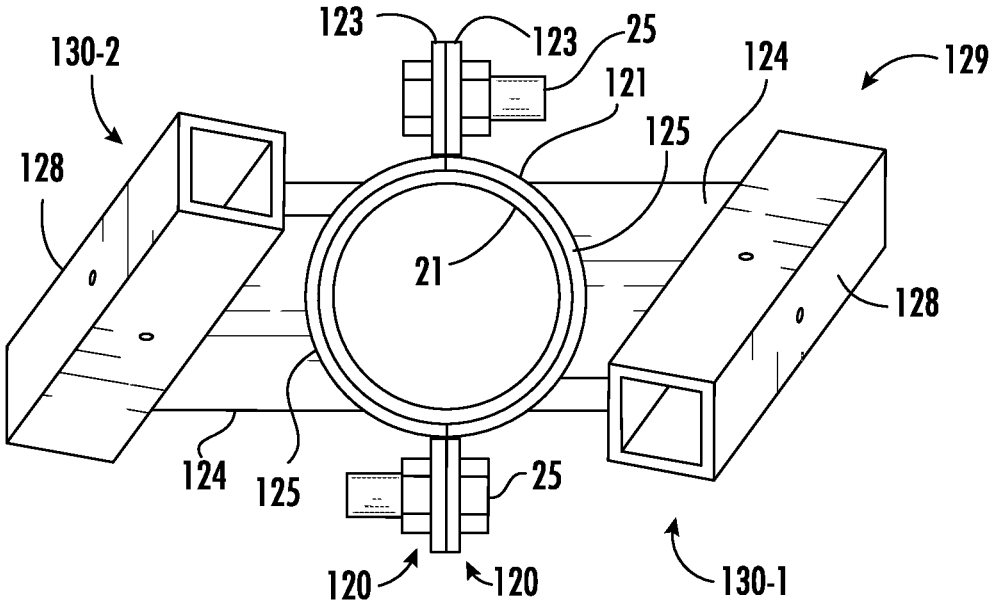
FIG. 8C is a top plan view of the pile connection apparatus and vertical pile of FIG. 8A.
Figure 8D:
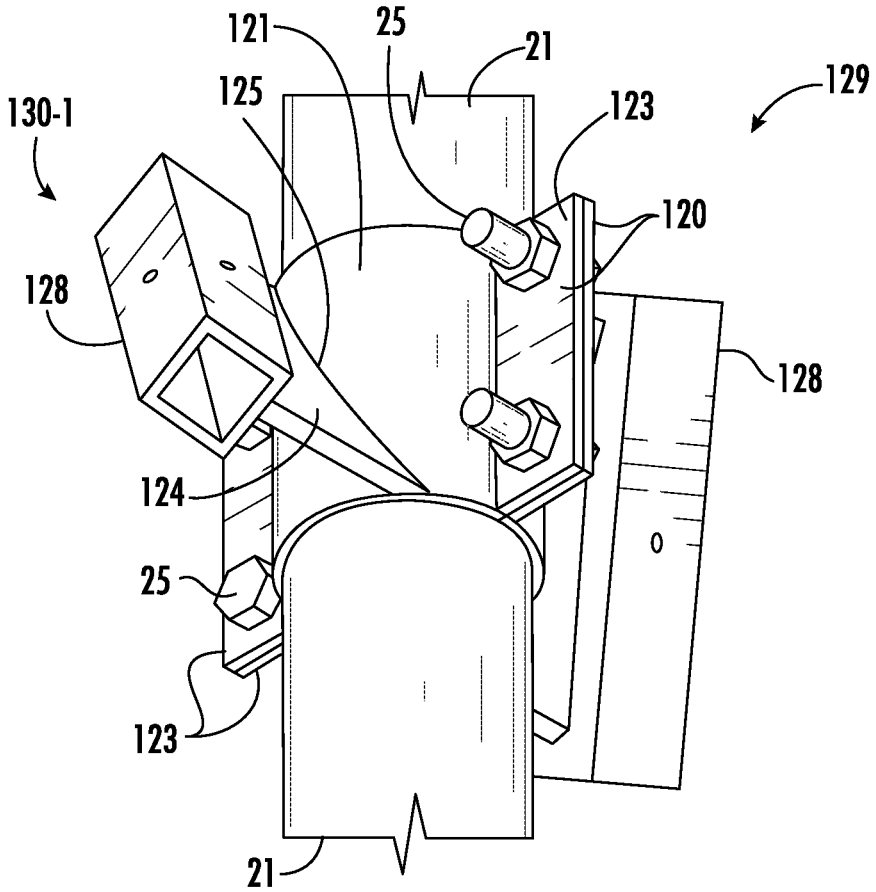
FIG. 8D is a lower perspective view of the pile connection apparatus and vertical pile of FIG. 8A.

FIG. 7A is a top plan view of first and second fixtures 110-1, 110-2 configured to be coupled together with fasteners (e.g., 25 as shown in FIG. 5A) that are configured to extend through holes (defined in gusset members 14A, 14D at regions 126) to form a pile connection apparatus according to one embodiment. Dashed lines 126A represent paths for insertion of fasteners (e.g., 25 as shown in FIG. 5A) to enable coupling between the fixtures 110-1, 110-2. Each fixture 110-1, 110-2 includes five gusset members 114A-114E, a single connecting member 116 connecting the gusset members 114A-114E, a collar portion 111, and four micropile sleeves 78A-78D indirectly coupled to the gusset members 114A-114E through the connecting member 116. Fastener receiving holes (not shown) are defined in selected gusset members 114A, 114E. Each collar portion 111 has a wall 113 defining a recess 112 for receiving a portion of a vertical pile (not shown). FIG. 7B shows a gusset member 114A of the fixture 110, showing fastener receiving holes 107, 108, as well as depicting a length L, a proximal height (Hp) (at an edge adjacent to the collar portion 111) that is greater than the distal height HD (at an edge distal from the collar portion 111, and proximate to the connecting member 116). In use of the fixtures 110-1, 110-2 of FIG. 7A, a pile may be positioned vertically relative to a ground (and optionally, driven partially into the ground) to form a vertical pile; the fixtures 110-1, 110-2 may be coupled (using fasteners extending through the holes 107, 108) to the vertical pile; and multiple micropiles may be inserted through the micropile sleeves 78A-78D into the ground.

FIGS. 8A-8D illustrate a first alternative pile connection apparatus 129 including two fixtures 130-1, 130-2 affixed to a cylindrical vertical pile 21, in which such figures provide side elevational, front elevational, top plan, and lower perspective views, respectively. The pile connection apparatus 129 includes two complementary fixtures 130-1, 130-2 joined with fasteners 25, with each fixture 130-1, 130-2 having a collar portion 120 with a curved wall section 121, and one gusset member 124 extending from the collar portion 120 to a micropile sleeve 128. Each collar portion 120 includes outwardly projecting tab extensions 123 through which fastener receiving holes are defined. Unlike the embodiments shown in the preceding figures, the apparatus 129 lacks any connecting members spanning between micropile sleeves 128. As shown, each gusset member 124 lies along an imaginary plane that is non-vertical, but that is parallel to a central axis $A_2$ (shown in FIG. 8B) of the joined micropile sleeve 128. The central axis $A_2$ of each micropile sleeve 128 is non-parallel to a central axis $A_1$ of the vertical pile 21. To permit each gusset member 124 to be joined to the curved wall section 121 of the collar portion 120, a proximal surface (or proximal edge) 125 of the gusset member 124 is curved in shape to substantially conform to a curvature of the curved wall section 121.

Figure 9A:
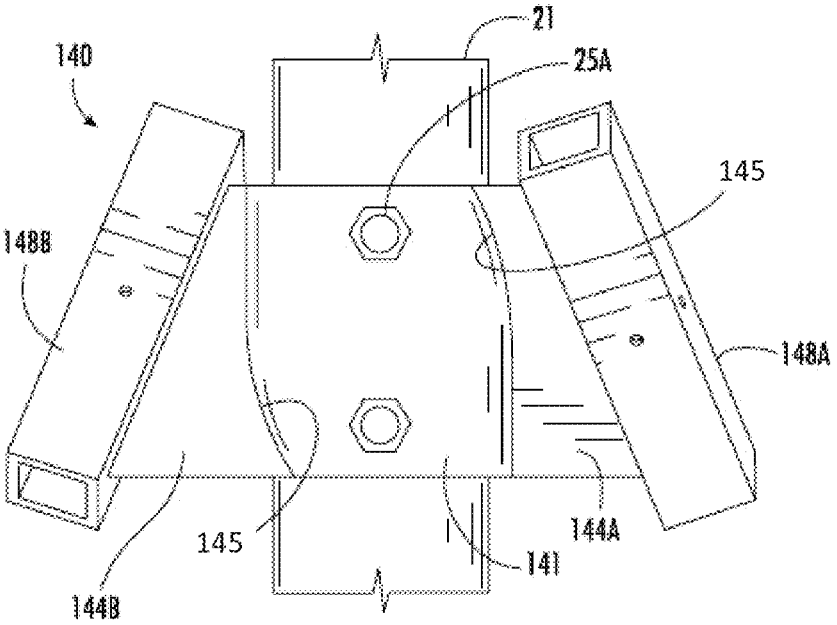
FIG. 9A is a front elevational view of a pile connection apparatus including a single fixture with a collar fitting around an entire perimeter of a vertical pile and fasteners extending through the collar and the vertical pile, with two opposing gusset members extending from the collar to two micropile sleeves, and with each gusset member being inclined away from vertical and having a curved proximal surface to conform to a curved surface of a wall of the collar portion.
Figure 9B:
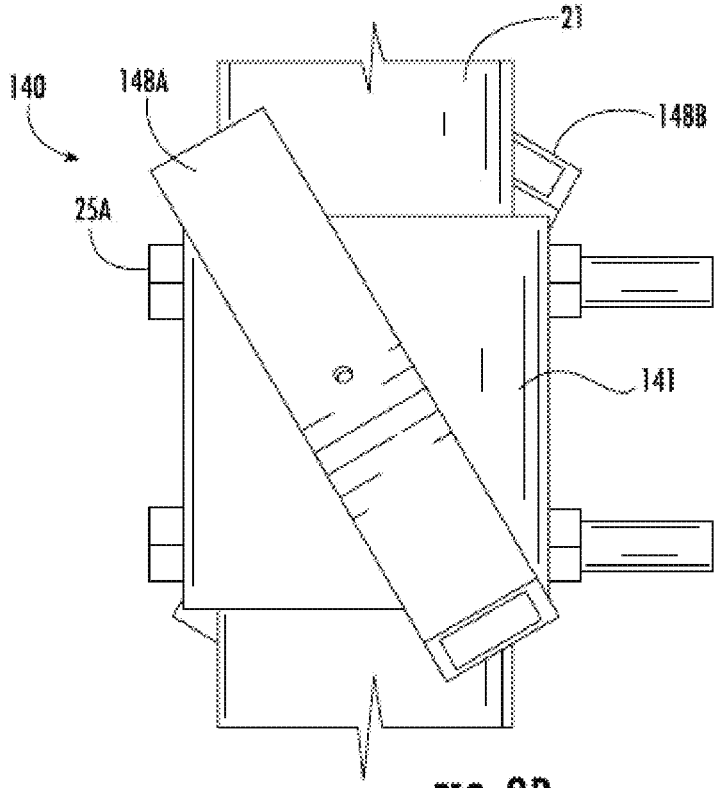
FIG. 9B is a side elevational view of the pile connection apparatus and vertical pile of FIG. 9A.
Figure 9C:
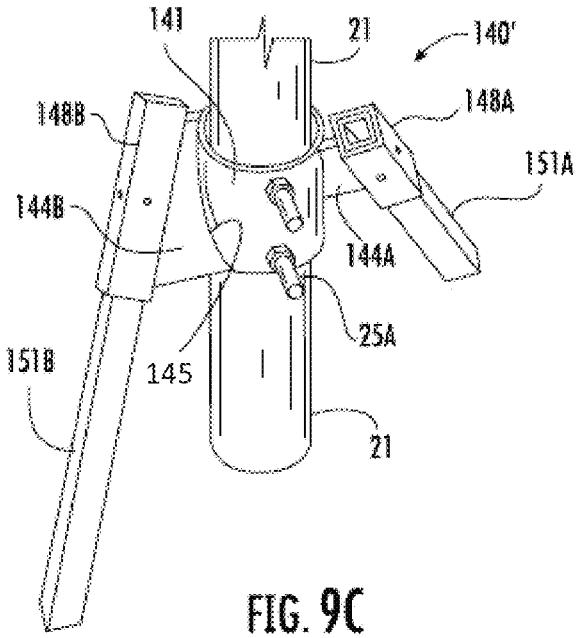
FIG. 9C is an upper perspective view of the pile connection apparatus and vertical pile of FIG. 9A, with micropiles received by the micropile sleeves.
Figure 9D:
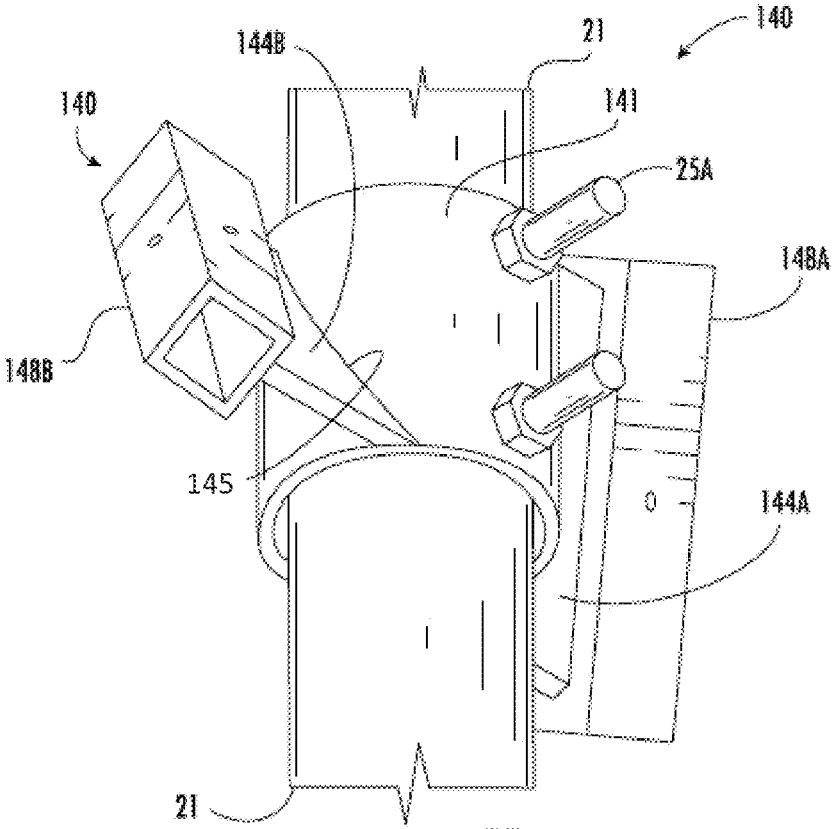
FIG. 9D is a lower perspective view of the pile connection apparatus and vertical pile of FIG. 9A.

FIGS. 9A-9D illustrate a pile connection apparatus including a single fixture 140 with a collar 141 fitting around an entire perimeter of a vertical pile 21, and including fasteners 25A extending through the collar 141 and the vertical pile 21. Two opposing gusset members 144A-144B extend from the collar 141 to two micropile sleeves 148A, 148B (each configured to receive a corresponding micropile 151A, 151B as shown in FIG. 9C), with each gusset member 144A, 144B lying along a respective imaginary plane that is inclined away from vertical. Each gusset member 144A, 144B has a curved proximal surface (or proximal edge) 145 to conform to a curved surface of the collar 141.

It is to be appreciated that in any embodiments shown herein, gusset members may be arranged along imaginary planes (e.g., definable through an upper surface, a lower surface, a proximal surface adjacent to a collar portion, and a distal surface distal from a collar portion) that are non-vertical and that are substantially parallel to a sleeve axis of a micropile sleeve affixed to the gusset member. If such a gusset member is coupled to a collar portion having a curved wall, then a proximal surface (or proximal edge) of the gusset member may be curved to substantially conform to a curvature of the curved wall of the collar portion.

The present disclosure includes a method for supporting a vertical pile. The method comprises: positioning a pile vertically to a ground to form a vertical pile; coupling a pile connection apparatus as disclosed herein to the vertical pile, with the first collar portion of the first fixture receiving a first portion of the vertical pile, with the second collar portion of the second fixture receiving a second portion of the vertical pile, and with the plurality of fasteners cooperating with the first and second collar portions to cause the vertical pile to be frictionally engaged therebetween; inserting a plurality of first micropiles through the plurality of first micropile sleeves and into the ground; and inserting a plurality of second micropiles through the plurality of second micropile sleeves and into the ground. In certain embodiments, a pile connection apparatus may be coupled to the vertical pile after a portion of the vertical pile is driven into the ground. In certain embodiments, a pile connection may be coupled to the vertical pile before a portion of the vertical pile is driven into the ground.

Many modifications and other embodiments of the embodiments set forth herein will come to mind to one skilled in the art to which the embodiments pertain having the benefit of the teachings presented in the foregoing descriptions and the associated drawings. Therefore, it is to be understood that the description and claims are not to be limited to the specific embodiments disclosed and that modifications and other embodiments are intended to be included within the scope of the appended claims. It is intended that the embodiments cover the modifications and variations of the embodiments provided they come within the scope of the appended claims and their equivalents. Although specific terms are employed herein, they are used in a generic and descriptive sense only and not for purposes of limitation.

What is claimed is:

1. A pile connection apparatus for supporting a vertical pile, the apparatus comprising:

a first fixture comprising a first collar portion, a plurality of first micropile sleeves, a plurality of first gusset members coupling the plurality of first micropile sleeves to the first collar portion, and at least one first connecting member coupling adjacent first gusset members of the plurality of first gusset members;

wherein:

the first collar portion comprises a first recess configured to receive a first portion of the vertical pile, the first recess being bounded by a first wall configured to contact a first pile surface of the first portion of the vertical pile;

the plurality of first gusset members project laterally outward from the first collar portion;

an entirety of the at least one first connecting member is arranged proximate to a perimeter of the first fixture and is laterally displaced relative to the first collar portion, with one or more gaps between the first collar portion and the at least one first connecting member;

the at least one first connecting member has a cross-sectional height extending continuously in a vertical direction, and has a cross-sectional width extending continuously in a lateral direction oriented perpendicular to the vertical direction and oriented radially outward relative to the first collar portion, wherein the cross sectional height is greater than the cross-sectional width; and one or more of (i) the first collar portion and (ii) at least one first gusset member of the plurality of first gusset members comprises and/or is configured to receive at least one fastener to cause the first wall to engage the first pile surface.

2. The pile connection apparatus of claim 1, wherein the plurality of first gusset members are intermediately coupled to the plurality of first micropile sleeves, with a first connecting member of the at least one first connecting member arranged between adjacent first gusset members of the plurality of first gusset members.

3. The pile connection apparatus of claim 1, wherein:

each first gusset member of the plurality of first gusset members comprises: (i) a length extending in a direction from the first collar portion to a corresponding first micropile sleeve of the plurality of first micropile sleeves, (ii) a width orthogonal to the length, (iii) a proximal height at a point of contact with the first collar portion, and (iv) a distal height at a point of contact with the at least one first connecting member; and for each first gusset member, the proximal height is greater than the distal height, and the distal height is greater than the width.

4. The pile connection apparatus of claim 1, wherein:

each first micropile sleeve of the plurality of first micropile sleeves has a first sleeve inlet, a first sleeve outlet, and a first sleeve axis extending through the first sleeve inlet and the first sleeve outlet; and for each first micropile sleeve, the first sleeve axis is non-parallel to the vertical pile to be supported by the pile connection apparatus.

5. The pile connection apparatus of claim 4, wherein:

each first gusset member of the plurality of first gusset members comprises: a first upper surface, a first lower surface, a first proximal surface proximal to the first collar portion, and a first distal surface distal from the first collar portion;

for each first gusset member, a first imaginary plane is definable through the first upper surface, the first lower surface, the first proximal surface, and the first distal surface; and for each first gusset member, the first imaginary plane is non-vertical, and is substantially parallel to the first sleeve axis of the first micropile sleeve coupled to the first gusset member.

6. The pile connection apparatus of claim 5, wherein:

the first wall is curved in shape, with the pile connection apparatus being configured to support a vertical pile having a cylindrical shape; and the first proximal surface of each first gusset member abuts the first wall, with the first proximal surface being curved in shape to substantially conform to a curvature of the first wall.

7. The pile connection apparatus of claim 1, further comprising:

a second fixture comprising a second collar portion, a plurality of second micropile sleeves, a plurality of second gusset members coupling the plurality of second micropile sleeves to the second collar portion, and at least one second connecting member coupling adjacent second gusset members of the plurality of second gusset members;

wherein:

the second collar portion comprises a second recess configured to receive a second portion of the vertical pile, the second recess being bounded by a second wall configured to contact a second pile surface of the second portion of vertical pile, wherein the second portion of the vertical pile opposes the first portion of the vertical pile;

the plurality of second gusset members project laterally outward from the second collar portion;

an entirety of the at least one second connecting member is laterally displaced relative to the second collar portion;

one or more of (iii) the second collar portion and (iv) the at least one second gusset member of the plurality of second gusset members comprises and/or is configured to receive the at least one fastener to cause the second wall to engage the second pile surface, with the second recess of the second fixture opposing the first recess of the first fixture.

8. The pile connection apparatus of claim 7, wherein:

each second micropile sleeve of the plurality of second micropile sleeves has a second sleeve inlet, a second sleeve outlet, and a second sleeve axis extending through the second sleeve inlet and the second sleeve outlet; and for each second micropile sleeve, the second sleeve axis is non-parallel to the vertical pile to be supported by the pile connection apparatus.

9. The pile connection apparatus of claim 7, wherein:

the first recess is configured to receive the first portion of the vertical pile extending around a first perimetral portion spanning a range of 40 to 50 percent of a perimeter of the vertical pile, and the second recess is configured to receive the second portion of the vertical pile extending around a second perimetral portion spanning a range of 40 to 50 percent of the perimeter of the vertical pile.

10. The pile connection apparatus of claim 7, wherein;

a plurality of first fastener openings are defined in one or more of (i) the first collar portion and (ii) the at least one first gusset member of the plurality of first gusset members, and a plurality of second fastener openings is defined in one or more of (iii) the second collar portion and (iv) the at least one second gusset member of the plurality of second gusset members, the at least one fastener comprises a plurality of fasteners, and each first fastener opening is configured to be aligned with a corresponding second fastener opening to receive one fastener of the plurality of fasteners extending through the aligned first and second fastener openings.

11. The pile connection apparatus of claim 7, wherein:

one or more fasteners of the at least one fastener is affixed to or integrated with one or more of (i) the first collar portion, (ii) at least one first gusset member of the plurality of first gusset members, (iii) the second collar portion, and (iv) the at least one second gusset member of the plurality of second gusset members.

12. The pile connection apparatus of claim 1, wherein the plurality of first gusset members comprises at least three first gusset members.

13. The pile connection apparatus of claim 1, wherein one or more of (i) the first collar portion and (ii) the at least one first gusset member of the plurality of first gusset members comprises fastener openings configured to receive at least one U-bolt that is configured to extend around a portion of a perimeter of the vertical pile.

14. A pile connection apparatus for supporting a vertical pile, the apparatus comprising:

a first fixture comprising a first collar portion, a plurality of first micropile sleeves, a plurality of first gusset members coupling the plurality of first micropile sleeves to the first collar portion, and at least one first connecting member coupling adjacent first gusset members of the plurality of first gusset members, wherein:

the first collar portion comprises a first recess configured to receive a first portion of the vertical pile, the first recess being bounded by a first wall configured to contact a first pile surface of the first portion of the vertical pile;

the plurality of first gusset members project laterally outward from the first collar portion;

an entirety of the at least one first connecting member is arranged proximate to a perimeter of the first fixture and is laterally displaced relative to the first collar portion, with one or more gaps between the first collar portion and the at least one first connecting member; and the at least one first connecting member has a cross-sectional height in a vertical direction, and has a cross-sectional width in a lateral direction extending perpendicular to the vertical direction and extending radially outward from the first collar portion, wherein the cross sectional height of the at least one first connecting member is greater than the cross-sectional width thereof;

a second fixture comprising a second collar portion, a plurality of second micropile sleeves, a plurality of second gusset members coupling the plurality of second micropile sleeves to the second collar portion, and at least one second connecting member coupling adjacent second gusset members of the plurality of second gusset members;

wherein:

the second collar portion comprises a second recess configured to receive a second portion of the vertical pile, the second recess being bounded by a second wall configured to contact a second pile surface of the second portion of the vertical pile, wherein the second portion of the vertical pile opposes the first portion of the vertical pile;

the plurality of second gusset members project laterally outward from the second collar portion;

an entirety of the at least one second connecting member is arranged proximate to a perimeter of the second fixture and is laterally displaced relative to the second collar portion, with one or more gaps between the second collar portion and the at least one second connecting member; and the at least one second connecting member has a cross-sectional height in a vertical direction, and has a cross-sectional width in a lateral direction extending perpendicular to the vertical direction and extending radially outward from the second collar portion, wherein the cross sectional height of the at least one second connecting member is greater than the cross-sectional width thereof; and a plurality of fasteners configured to cooperate with the first fixture and the second fixture to cause the first wall to engage the first pile surface, to cause the second wall to engage the second pile surface, and to cause the vertical pile to be frictionally engaged between the first fixture and the second fixture.

15. The pile connection apparatus of claim 14, wherein:

each first gusset member of the plurality of first gusset members comprises: (i) a first length extending in a direction from the first collar portion to a corresponding first micropile sleeve of the plurality of first micropile sleeves, (ii) a first width orthogonal to the length, (iii) a first proximal height at a point of contact with the first collar portion, and (iv) a first distal height at a point of contact with the at least one first connecting member;

each second gusset member of the plurality of second gusset members comprises: (i) a second length extending in a direction from the second collar portion to a corresponding second micropile sleeve of the plurality of second micropile sleeves, (ii) a second width orthogonal to the length, (iii) a second proximal height at a point of contact with the second collar portion, and (iv) a second distal height at a point of contact with the at least one second connecting member;

for each first gusset member, the first proximal height is greater than the first distal height, and the first distal height is greater than the first width; and for each second gusset member, the second proximal height is greater than the second distal height, and the second distal height is greater than the second width.

16. The pile connection apparatus of claim 14, wherein:

each first micropile sleeve of the plurality of first micropile sleeves has a first sleeve inlet, a first sleeve outlet, and a first sleeve axis extending through the first sleeve inlet and the first sleeve outlet;

each second micropile sleeve of the plurality of second micropile sleeves has a second sleeve inlet, a second sleeve outlet, and a second sleeve axis extending through the second sleeve inlet and the second sleeve outlet;

for each first micropile sleeve, the first sleeve axis is non-parallel to the vertical pile to be supported by the pile connection apparatus; and for each second micropile sleeve, the second sleeve axis is non-parallel to the vertical pile to be supported by the pile connection apparatus.

17. The pile connection apparatus of claim 16, wherein:

each first gusset member of the plurality of first gusset members comprises: a first upper surface, a first lower surface, a first proximal surface proximal to the first collar portion, and a first distal surface distal from the first collar portion;

for each first gusset member, a first imaginary plane is definable through the first upper surface, the first lower surface, the first proximal surface, and the first distal surface;

for each first gusset member, the first imaginary plane is non-vertical, and is substantially parallel to the first sleeve axis of the first micropile sleeve coupled to the first gusset member;

each second gusset member of the plurality of second gusset members comprises: a second upper surface, a second lower surface, a second proximal surface proximal to the second collar portion, and a second distal surface distal from the second collar portion;

for each second gusset member, a second imaginary plane is definable through the second upper surface, the second lower surface, the second proximal surface, and the second distal surface; and for each second gusset member, the second imaginary plane is non-vertical, and is substantially parallel to the second sleeve axis of the second micropile sleeve coupled to the second gusset member.

18. The pile connection apparatus of claim 17, wherein:

the first wall is curved in shape, with the pile connection apparatus being configured to support the vertical pile having a cylindrical shape;

the first proximal surface of each first gusset member abuts the first wall, with the first proximal surface being curved in shape to substantially conform to a curvature of the first wall;

the second wall is curved in shape, with the pile connection apparatus being configured to support the vertical pile having a cylindrical shape; and the second proximal surface of each second gusset member abuts the second wall, with the second proximal surface being curved in shape to substantially conform to a curvature of the second wall.

19. The pile connection apparatus of claim 14, wherein:

the vertical pile configured to be supported by the pile connection apparatus comprises a pile cross-sectional width or diameter; the first recess comprises a maximum horizontal depth with a dimension in a range of 40 to 50 percent of the pile width or diameter; and the second recess comprises a maximum horizontal depth with a dimension in a range of 40 to 50 percent of the pile width or diameter.

20. The pile connection apparatus of claim 19, wherein:

a plurality of first fastener openings are defined in one or more of (i) the first collar portion and (ii) at least one first gusset member of the plurality of first gusset members, a plurality of second fastener openings is defined in one or more of (iii) the second collar portion and (iv) at least one second gusset member of the plurality of second gusset members, and each first fastener opening is configured to be aligned with a corresponding second fastener opening to receive one fastener of the plurality of fasteners extending through the aligned first and second fastener openings.

21. The pile connection apparatus of claim 14, wherein one or more fasteners of the plurality of fasteners is affixed to or integrated with one or more of (i) the first collar portion, (ii) at least one first gusset member of the plurality of first gusset members, (iii) the second collar portion, and (iv) at least one second gusset member of the plurality of second gusset members.

22. A method for supporting a vertical pile, the method comprising:

positioning a pile vertically to a ground to form a vertical pile;

coupling a pile connection apparatus according to claim 14 to the vertical pile, with the first collar portion of the first fixture receiving a first portion of the vertical pile, with the second collar portion of the second fixture receiving a second portion of the vertical pile, and with the plurality of fasteners cooperating with the first and second collar portions to cause the vertical pile to be frictionally engaged therebetween;

inserting a plurality of first micropiles through the plurality of first micropile sleeves and into the ground; and inserting a plurality of second micropiles through the plurality of second micropile sleeves and into the ground.

* * * * *